US006374644B1

(12) United States Patent
Rhode et al.

(10) Patent No.: US 6,374,644 B1
(45) Date of Patent: Apr. 23, 2002

(54) EQUIPMENT WASHER

(75) Inventors: Randall J. Rhode; Margie A. Rhode, both of Westbank (CA)

(73) Assignee: E Sportra Wash Systems Inc., Westbank (CA)

( * ) Notice: Subject to any disclaimer, the term of this patent is extended or adjusted under 35 U.S.C. 154(b) by 0 days.

(21) Appl. No.: 09/376,319

(22) Filed: Aug. 18, 1999

Related U.S. Application Data

(60) Provisional application No. 60/096,841, filed on Aug. 18, 1998.

(51) Int. Cl.[7] ..... D06F 23/02

(52) U.S. Cl. ..... 68/20; 24/58; 24/142; 24/143

(58) Field of Search ..... 68/20, 24, 58, 68/140, 143, 152

(56) References Cited

U.S. PATENT DOCUMENTS

| | | | | | |
|---|---|---|---|---|---|
| 33,661 | A | | 11/1861 | Parkhurst | |
| 119,859 | A | | 10/1871 | Lee | |
| 135,805 | A | | 2/1873 | Henson | |
| 182,209 | A | * | 9/1876 | Mary | 68/142 |
| 486,763 | A | | 11/1892 | Campbell | |
| 619,910 | A | | 2/1899 | Stone | |
| 620,470 | A | * | 2/1899 | Mallinson | 68/143 |
| 659,921 | A | | 10/1900 | Hartsough | |
| 687,374 | A | * | 11/1901 | Hamer | 68/152 |
| 687,742 | A | | 12/1901 | Gilmore | |
| 707,409 | A | * | 8/1902 | Guitar | 68/143 |
| 1,358,601 | A | | 11/1920 | Witthuhn | |
| 1,665,118 | A | * | 4/1928 | Thompson et al. | 68/143 |
| 1,869,674 | A | * | 8/1932 | Duffy | 68/152 |
| 2,015,119 | A | | 9/1935 | McEwen | |
| 2,098,890 | A | * | 11/1937 | Schmitz Jr. | 68/152 |
| 2,426,843 | A | | 9/1947 | Phair | |
| 2,431,418 | A | * | 11/1947 | Olen | 68/152 |
| 2,887,354 | A | * | 5/1959 | Lichtenstein et al. | 68/152 |
| 3,036,616 | A | | 5/1962 | Allen | |
| 3,724,095 | A | | 4/1973 | Laue et al. | 34/139 |
| 3,744,402 | A | * | 7/1973 | Piegza et al. | 68/143 |
| 3,840,998 | A | | 10/1974 | Marcussen | |
| 3,853,622 | A | | 12/1974 | Rutten | |
| 4,091,548 | A | | 5/1978 | Daily | 34/133 |
| 4,109,397 | A | | 8/1978 | Daily | 34/239 |
| 4,370,992 | A | | 2/1983 | Choudhury et al. | |
| 4,617,743 | A | | 10/1986 | Barnard | 34/109 |
| 4,677,760 | A | | 7/1987 | St. Louis | 34/90 |
| 4,703,565 | A | | 11/1987 | Kantor | |
| 5,080,312 | A | | 1/1992 | Ebey | |
| 5,220,734 | A | | 6/1993 | Carver | |
| 5,276,979 | A | | 1/1994 | Gordon, Sr. | |
| 5,398,428 | A | | 3/1995 | Wallace | |
| 5,519,949 | A | | 5/1996 | Gibson, Jr. | |
| 5,546,771 | A | | 8/1996 | Bonar | |
| 5,562,114 | A | | 10/1996 | St. Martin | |
| 5,743,025 | A | | 4/1998 | Jordan, Jr. | |
| 5,803,605 | A | | 9/1998 | Masi | |
| 5,907,961 | A | * | 6/1999 | Lee et al. | 68/152 |

FOREIGN PATENT DOCUMENTS

| | | | | |
|---|---|---|---|---|
| AU | 125572 | * | 9/1947 | 68/143 |
| SU | 549537 | * | 4/1977 | 68/152 |

* cited by examiner

*Primary Examiner*—Frankie L. Stinson
(74) *Attorney, Agent, or Firm*—Antony C. Edwards

(57) ABSTRACT

A washing machine includes a frame, a tub rigidly mounted to the frame, and at least one basket rotatably mounted inside the tub. The basket is an open-lattice sided container having a releasably closable lid. The basket is adapted for holding articles of apparel or other flexible articles substantially stationary relative to the basket as the basket is rotated relative to the tub. A water supply cooperates with the tub for washing and rinsing the articles held in the basket.

29 Claims, 27 Drawing Sheets

EQUIPMENT WASHER
Randall J. Rhode
Application No. 09/376,319

EQUIPMENT WASHER

CROSS REFERENCE TO RELATED APPLICATION

This application priority from U.S. Provisional Patent Application No. 60/096,841 filed Aug. 18, 1998 titled Sports Equipment Washer.

FIELD OF THE INVENTION

This invention relates to the field of devices for washing clothing or other flexible articles.

BACKGROUND OF THE INVENTION

Anyone who has played sports, or lived with a person who plays sports such as football or hockey or like sports requiring the wearing of protective armour such as helmets, boots, shoulder pads and the like, is aware that, although the manufacturer of the equipment likely allows for the washing of such equipment, such equipment is only infrequently washed by hand due to the bulky nature of the pieces of equipment and hard armour which make using a conventional residential washing machine or laundromat washing machine tedious, difficult and in some cases impossible. Further, in some instances sports apparel, such as ballerina's shoes, cannot be washed in conventional washing machines due to the nature of the apparel, for example, due to fragility of the material, or otherwise. Other flexible articles such as harnesses for lifting bed-ridden invalids often become soiled and require washing. Due to their construction washing of such harnesses has in the past been done by hand.

Certainly, in the prior art, conventional washing machines, for example of the variety which have a wash tub with a generally centrally disposed vertically upright washing agitator, restrict the number or size of articles of sports equipment that may be washed at one time. Consequently, numerous washing cycles are required to merely wash one complete outfit of sports equipment, and larger items may not fit into the washing machine at all. Further, it has been found that the movement of the agitator causes damage to the equipment.

It is therefore an object of the present invention to provide a device and in a preferred embodiment a cooperating bag, mesh container, or the like, so that flexible apparel or most if not all of a sports equipment outfit may be placed into an easily accessible washing cage or basket, wherein the cage or basket is selectively closable and, once closed, agitatable within a water fight enclosure such as a washing machine tub. Specifically, it is an object to hold the article to be washed fixed in the cage or basket, and to move the entire cage or basket relative to the enclosure to obtain the flushing of water in and around the articles.

In the prior art, Applicant is aware of various patents relating to the placement of cages or baskets within clothes dryers. In particular, U.S. Pat. Nos. 4,091,548 and 4,109,397 which issued to Daily for a Door Mounted Stationary Drying Rack and a Rotatable, Non-Tumbling Drying Rack Respectively disclose how to place articles into conventional tumbling dryers so as to prevent articles placed into the dryer being, in the first instance rotated, and in the second instance tumbled. In the first instance Daily teaches a drying rack that maintains article stationary within an open lattice-work basket while the clothes dryer executes its tumble dry cycle. The basket is maintained stationary relative to the rotating drum of the dryer by being mounted to the dryer door. In the second instance, the basket is mounted to the drum of the dryer and provided with a cover which may be closed into the basket so as to apply pressure to articles in the basket so as to hold the articles stationary within the basket as the basket is rotated in tho dryer drum.

Applicant is also aware of U.S. Pat. No. 5,743,025 which issued to Jordon, Jr. for a Dryer Basket for Sneakers Insertable into a Clothes Dryer, As with the Daily '397 patent, Jordan, Jr. discloses the use of an open lattice-work basket mountable into the drum of a clothes dryer. A plurality of such baskets are mounted within the drum in radially spaced relation, removably secured within the drum adjacent to the drum tumbler vanes. The baskets are adapted for holding sneakers within the dryer drum, for tumbling of the sneakers without the noise that would otherwise be associated with the loose tumbling of sneakers in the dryer drum. Ballast is provided for placement into the baskets, the placement of the ballast serving to in maintain a balanced load within the dryer.

Applicant is further aware of U.S. Pat. No. 3,724,095 which issued to Laue et al for a Delicate Goods Tray which, similar to the Daily '548 patent teaches an open lattice container for holding articles stationary during turning of a dryer drum. Similarly, U.S. Pat. No. 4,617,743 which issued to Barnard for a Dryer Insert, Holder, Container and U.S. Pat. No. 5,276,979 which issued to Gordon, Sr. for a Shoe Drying Support Apparatus, both teach mounting an open lattice container into the drum of a dryer, the former for holding hosiery, tennis shoes and the like, and the latter two position canvas-type shoes and the like within the dryer drum. Both devices employ a telescoping rod to secure the container within the drum for rotation therewith.

U.S. Pat. No. 5,546,771 which issued to Bonar for a Combination Clothes and Dish Washer & Dryer discloses converting a clothes washer to a dish washer by removing the clothes washer agitator and installing a basket for holding dishes. A hot air dryer structure is mounted into the washer to dry the dishes when the clothes washer is used as a dish washer. In particular, an air dryer blower is provided for circulating hot air through the inside of the washing machine cabinet.

Summary of the Invention

In summary, the washing machine of the present invention includes a frame, a tub rigidly mounted to the frame, and at least one basket rotatably mounted inside the tub. The basket is an open-lattice sided container having a releasably closable lid. The basket is adapted for holding articles of apparel or other flexible articles substantially stationary relative to the basket as the basket is rotated relative to the tub. A water supply cooperates with the tub for washing and rinsing the articles held in the basket.

In one preferred embodiment, a mesh bag is provided for holding the articles. The mesh bag may be removably securable within the basket and may be compartmentalized for simultaneously holding various articles in spaced apart array. The mesh bag may include a main compartment of a generally rectangular parallelepiped shape mountable into the basket so as to lay the mesh bag flat.

The basket may be sized so as to fit therein the mesh bag folded in half and laid flat. A rigid, open-lattice spacer may be provided for placing sandwiched between folded-over halves of the mesh bags.

In a further aspect, the present invention may be described as washing and drying device for flexible articles. The device includes a watertight housing, a rotatable frame rotatably mounted within the housing for rotation of the frame about an axis of rotation, a plurality of water porous baskets mounted to the frame. Each basket has a releasably securable lid and means for securing the flexible articles in the basket so as to releasably hold the articles substantially stationary relative to the basket as the frame is rotated relative to the housing. A selectively controllable drive rotates the frame relative to the housing. A wash water supply and drain cooperate with the housing for, respectively, pressurized supply of wash water into contact with the baskets, and for draining the wash water. A forced air dryer may be mounted to the housing for drying the articles in the baskets as the baskets are rotated on the frame relative to the housing.

Advantageously, the forced air dryer has an inlet mounted to the housing at a first position on the housing, and an exhaust outlet mounted to the housing at a second position on the housing. A second position is radially spaced from the first position about the axis of rotation so that, when rotated about the axis of rotation in a first direction, a basket rotates a first distance from the inlet to the exhaust outlet. When rotated about the axis of rotation in a second direction opposite to the first direction about the axis of rotation, the basket rotates a second distance from the inlet to the exhaust outlet. When the first and second distances are not equal, during a drying cycle the frame and the baskets are rotated so as to pass from the inlet to the exhaust outlet along which ever distance is the longer distance of either the first or second distances. This provides a maximum dwell time in the housing of an airstream forced into the housing through the inlet into drying contact with the articles in the baskets before the airstream exits the housing through the exhaust outlet.

The wash water supply may comprise at least one spray nozzle for injecting wash water into the housing in a spray directed to include a portion of the spray perpendicular to the axis of rotation. The spray nozzles may include a pair of banks of spray nozzles radially spaced apart in the housing about the axis of rotation.

In a further aspect of the present invention each basket is drawer-mounted into the frame for sliding removal or exposure of each basket from the frame. A door in the housing provides access to the frame. The lid on each basket is operable once the basket is slid from inside the frame through the door so as to facilitate loading and unloading the articles from the basket. The frame may include slides so that each basket may be slid on the slides generally parallel to the axis of rotation through the door. Further, the slides may be telescopic slides mounted in sliding cooperation to the frame and to each basket. The frame may be rotated so as to sequentially position each basket adjacent the door for sequential access to the plurality of baskets.

In yet a further aspect, the housing is a cylindrical drum radially symmetric about the axis of rotation and the frame is a cage symmetrically shaped relative to the axis of rotation, wherein the plurality of water porous baskets are mounted in radially spaced array on the cage, radially spaced about the axis of rotation. The baskets are slidably mounted on the cage for sliding of each basket from the housing when the cage is stationary before engaging a washing or drying cycle of the device.

Advantageously, the baskets are open-lattice rigid baskets and further comprise an air and fluid porous spacer for placing between the articles when held within each basket for facilitating fluid and air flow between the articles. Each basket may be generally rectangular, one side of the basket conformally curved to correspond in shape to a cylindrical inner surface of the housing. The cage may be a cylindrical frame-work of rigid hoops held rigidly apart and rigidly perpendicular to a center axis member by radially spaced apart spokes, the center axis member co-axial with the axis of rotation. The hoops are sized for snug fitment within the inner surface of the housing. The inner surface of the housing may be a rigid perforated liner spaced radially inwardly from an exterior cylindrical wall of the housing. Each the basket may further comprise a removable compartmentalized porous bag releasably mountable into each the basket. The bag may be sized to fold over the spacer and when so folded to snugly fit into the basket. The compartments within the bag are porous and sized to firmly hold specific articles within the bag in an optimized spatial relationship relative to the frame and the housing when the bag is releasably mounted in a basket for optimized washing penetration of the wash water into and through the articles and for optimized penetration of drying air into or through the articles. The articles may be held in the bag in a substantially laid-flat orientation relative to an inner side of the basket, the inner side radially innermost in relation to the axis of rotation.

DETAILED DESCRIPTION OF PREFERRED EMBODIMENTS

Figure 1:
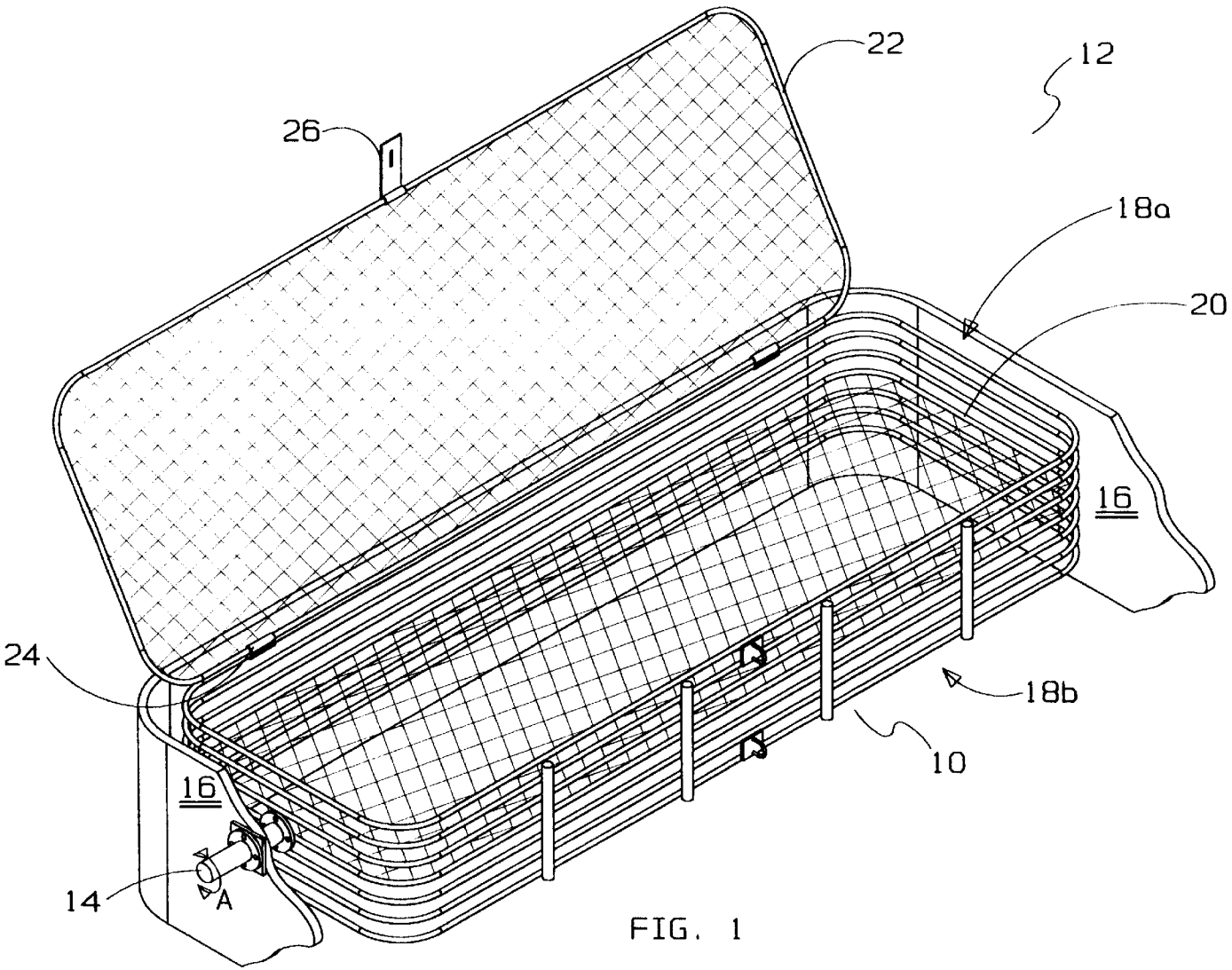
FIG. 1 is, in perspective cut away view, the sports equipment washer of the present invention.
Figure 5:
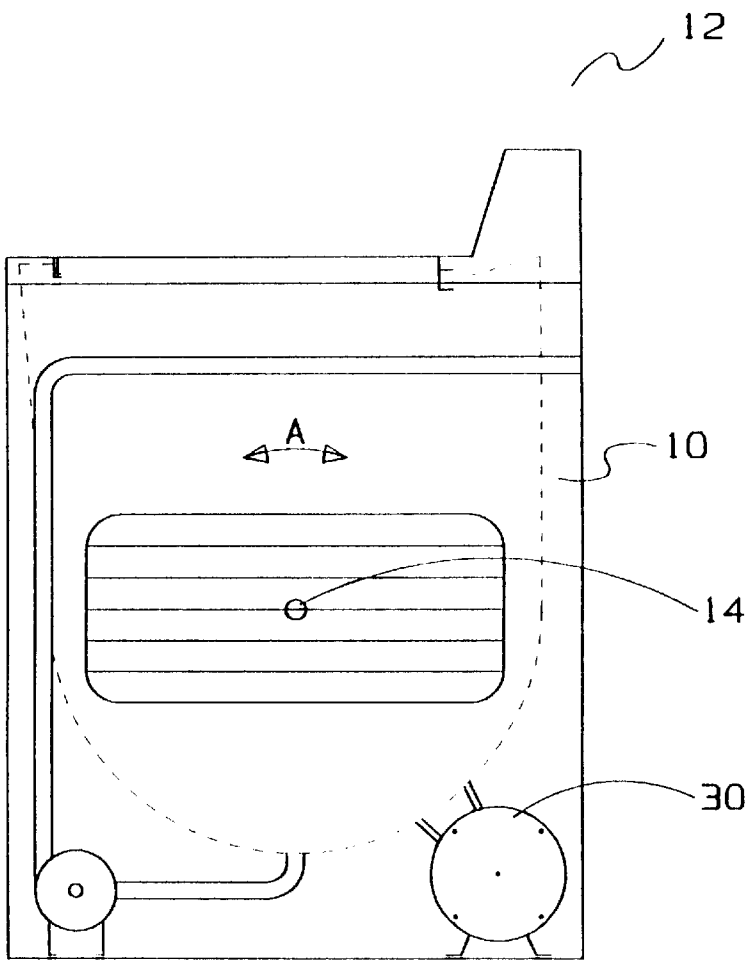
FIG. 5 is, in right side section view, the washing machine of FIG. 4.
Figure 4:
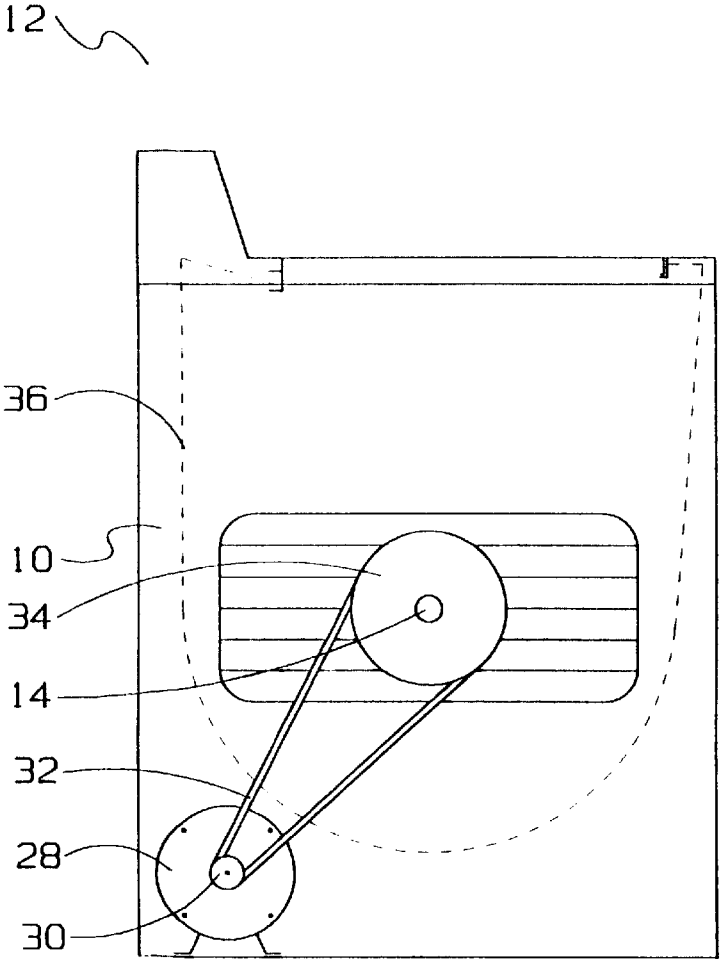
FIG. 4 is, in left side section view, a washing machine containing the sports equipment washer of the present invention.

Cage 10 as best seen in FIGS. 1, 4 and 5 may, as illustrated, be shaft mounted so as to extend between the laterally spaced-apart side walls of washing machine 12 or alternatively, wash tub 36. Cage 10 may be elongate, such as rectangular as depicted, and may be shaft mounted by means of longitudinally extending stub shafts or axles 14 rotatably mounted within water tight or sealed bearings known in the art so as to be journalled rotatably through side walls 16 of washing machine 12 or through the walls of wash tub 36. Advantageously, longitudinal stub shafts 14 lie along the longitudinal axis of symmetry of cage 10 so that, when empty, cage 10 is generally rotationally balanced about shafts 14.

In the preferred embodiment illustrated, cage 10 has opposed upper and lower baskets 18*a* and 18*b* respectively, the upper and lower baskets sharing a common floor 20 which serves as a divider between the upper and lower baskets within cage 10. Hinged covers 22, hingedly mounted to an edge of each basket, maybe pivoted on hinges 24 so as to selectively close the opening aperture into the respective upper or lower basket. Latch or clasp 26 or the like may be provided to selectively releasably lock covers 22 down onto upper or lower baskets 18*a* or 18*b* respectively.

Articles of sports equipment requiring washing may thus be placed into the upper or lower baskets and the covers 22 closed over the basket openings so as to enclose the articles of sports equipment within the baskets during the washing cycles. Because washing of the items of sports equipment is facilitated by flushing water through cage 10, advantageously, cover 22, baskets 18*a* and 18*b*, and floor 20 facilitate the flow of water therethrough by means of a grid work, perforations, mesh or a spaced-apart array of elongate members, which may be rigid, semi-rigid, or somewhat resilient bars, struts, fabric, or mesh webbing or string or rope webbing stretched between rigid frame members or any like means of forming a container which will remain structurally intact when agitated about the axis of rotation of shafts 14 during a washing cycle when cage 10 contains sodden items of sports equipment. Thus, as illustrated, cover 22 is a mesh, and the upper and lower baskets are illustrated as comprising a spaced-apart array of generally horizontal bars supported by vertical posts, and floor 20 is illustrated as a grid work or mesh. It is understood however the illustrations are not intended to be limiting, as cage 10 may be constructed by any appropriate means such as described above or by other materials perforated or otherwise which may be known in the art to provide for the efficient passing of fluids therethrough while providing structural integrity while agitated as for example by means of the mechanism illustrated in FIGS. 4 and 5.

As seen in FIGS. 4 and 5, cage 10, which is rigidly mounted to stub shafts 14, may be agitated in direction A about the longitudinal axis passing through co-linear shafts 14. Agitation may be accomplished by means of a drive belt and pulley arrangement wherein, for example, a three-speed electric drive motor 28 rotates drive shaft 30 thereby turning drive belt 32. Drive belt 32 turns pulley 34 rigidly mounted on to an end of one of stub shafts 14 protruding from the side walls, where it is understood that the side walls may be side walls 16 or the side walls of washing machine tub 36 (shown in dotted outline) contained internally within washing machine 12. Thus if a programmable logic controller (not shown) is provided, electric motor 28 may be programmably driven to execute washing machine cycles and to alternate or change direction of agitation of cage 10 about shaft 14.

Figure 2:
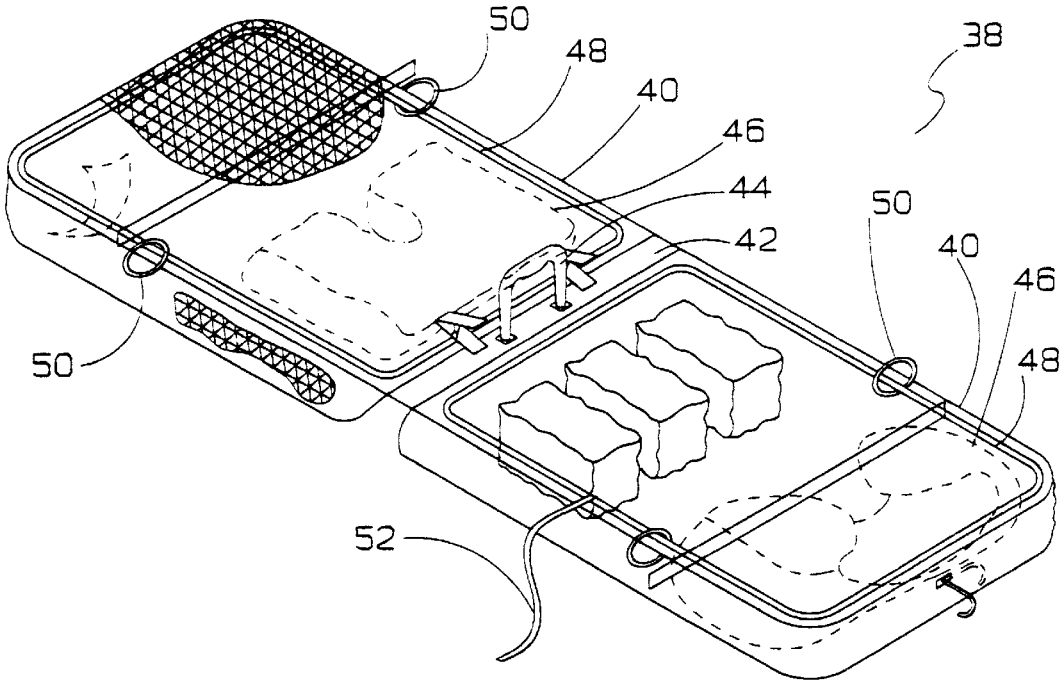
FIG. 2 is, in perspective view, a compartmentalized mesh equipment container laid flat according to a further aspect of the present invention.
Figure 3:
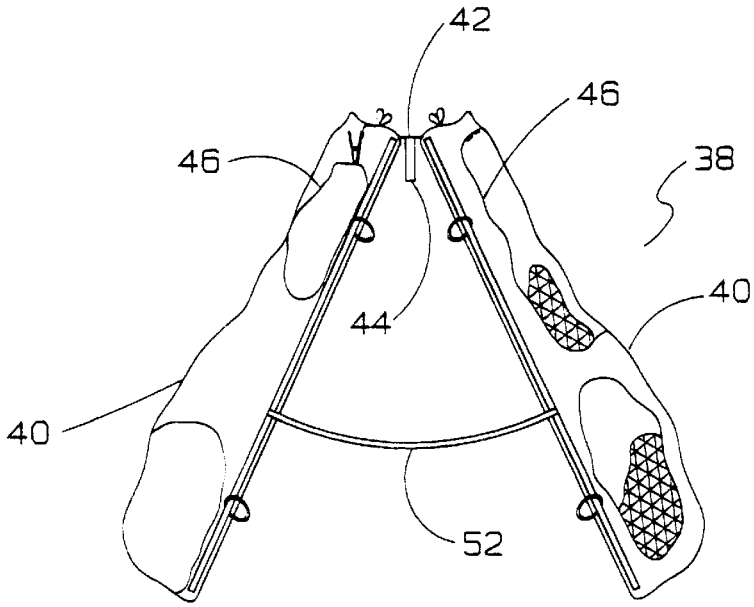
FIG. 3 is, in partially cut away side elevation view, the compartmentalized mesh equipment container of FIG. 2, partially folded.

In an alternative preferred embodiment of the present invention, a mesh equipment container in the nature of a garment bag is, as illustrated in FIGS. 2 and 3, provided for securely holding any convenient container all of the articles of sporting equipment. The container may be then easily and efficiently loaded into the correspondingly size baskets of cage 10. Mesh equipment container 38 may as illustrated, take the form of a garment bag having mesh side compartments 40 or the like extending in opposed relationship outwardly of a centrally disposed hinge 42 and handle 44. Side compartments 40 may be releasably closed by means of fasteners known in the art such as zippers or strips of hook and loop fasteners or the like, such that the openings which are conveniently large, may be opened to access the interior cavities of side compartments 40. Once articles of sports equipment 46 (shown in dotted outline) have been inserted into their corresponding internal compartments within side compartments 40, and side compartments 40 closed by means of releasable fasteners 48, the mesh equipment container 38 may then be placed into a basket within cage 10 without the worry that a piece of sporting equipment has either been left out or may be left behind were it not for the convenient compartmentalized containment of equipment 46 within container 38.

Although not intended to be limiting, it may be that each basket of cage 10 is sized to receive one mesh equipment container 38 whether it be that container 38 is folded in half about hinge 42 or laid flat placed into the basket. The scope of this invention is not limited to one particular set of relative dimensions of container 38 or the corresponding dimensions of each basket of cage 10 so that it may be that container 38 for a particular sport in no way resembles a garment bag whether laid flat or folded in half so long as items of sports equipment may be conveniently held within container 38 and container 38 place into cage 10, so long as container 38 is made of material allowing for the free passage of water or cleaning solution therethrough. In the embodiment as illustrated, advantageously, tie down rings or clips may be provided to releasably secure container 38 within cage 10. Tether 52 may be provided to assist holding sides 40 in a partially folded orientation about hinge 42 so that container 38 may be free standing allowing for draining and drying of equipment 46 held therein.

Thus to reiterate, in one preferred embodiment the mesh equipment container has two large separate compartments each of which can contain a number of pockets which accept specific items of sports equipment (hockey equipment being illustrated). Modifications may be made to suit different sports. A reinforcing strip of fabric or plastic is positioned transversely of the bag between the two compartments at the mid line, to permit the bag to be folded over conveniently in either direction. A carrying handle is attached to the reinforcing strip. At least one face of each compartment has a perimeter reinforcement, plastic or metal tubing to provide rigidity during the insertion of the soiled equipment. Additional pockets are provided in each compartment and need only to be attached to the same face as the perimeter reinforcement since items placed in the extremity of the bag must slip past the pockets. A hook at one end of the container permits hanging of the bag for drying—note that hook may be stored in a concealed manner—and when the container is hung up, the pants and shoulder pads are stretched by gravity into their normal shape. A strap is attached inside to restrain shoulder pads against movement during washing. Robust spring type clips may be attached to one compartment for securing the padded hockey pants in place during the washing cycle, and an additional pocket is also provided for odds and ends. The garment bag is also provided with a means whereby it can be suspended within the washer cage as illustrated I have shown rings through the mesh bag and around the perimeter reinforcement what ever that should be.

In use, the bag is folded open against the carrying handle and placed in an upright position supported by the perimeter reinforcement, a tether strap which is attached to one side of the bag is drawn toward and clipped to the other side of the bag to prevent the folded unit collapsing. The separate compartments which are closed by zippers or other means can be secured by the players personal identification tag. The internal pockets may have self closing elasticized openings. During transport, the bag is simply folded shut to expose the carrying handle and the tether strap is utilized to retain the bag in a closed folded position.

In a further alternative embodiment, the cage 10 may be cylindrical for insertion of sports items therein, or independently thereof or in addition thereto, cage 10 may be a drum or frame over which, that is, on the outside surface of which, may be releasably mounted an equipment container 38 whether flexible, as in a mesh bag, or inflexible as in a pre-formed container, for example "C"-shaped.

Figure 6:
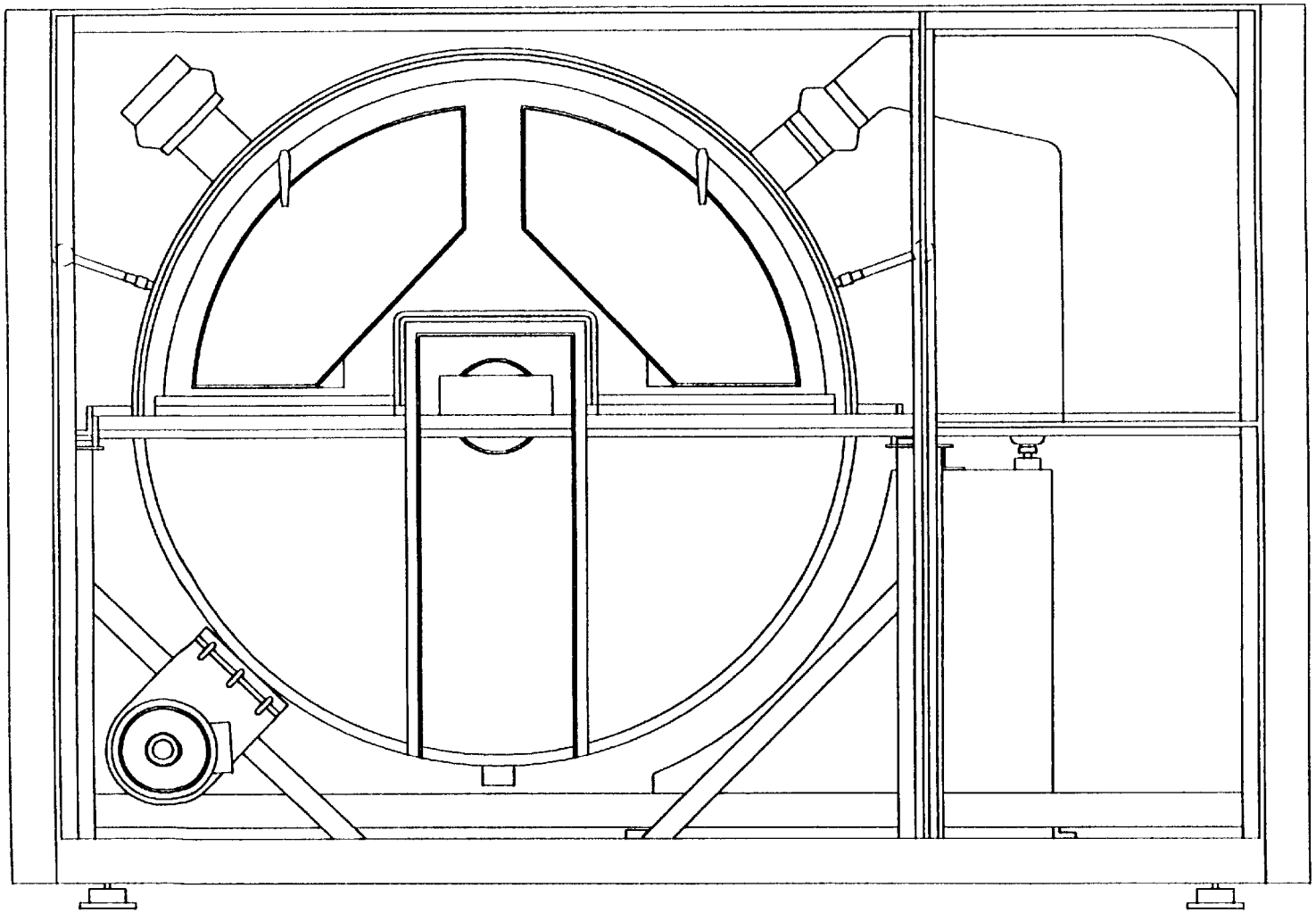
FIG. 6 is, in perspective view, an overview of an alternative embodiment of the machine of the present invention.
Figure 7A:
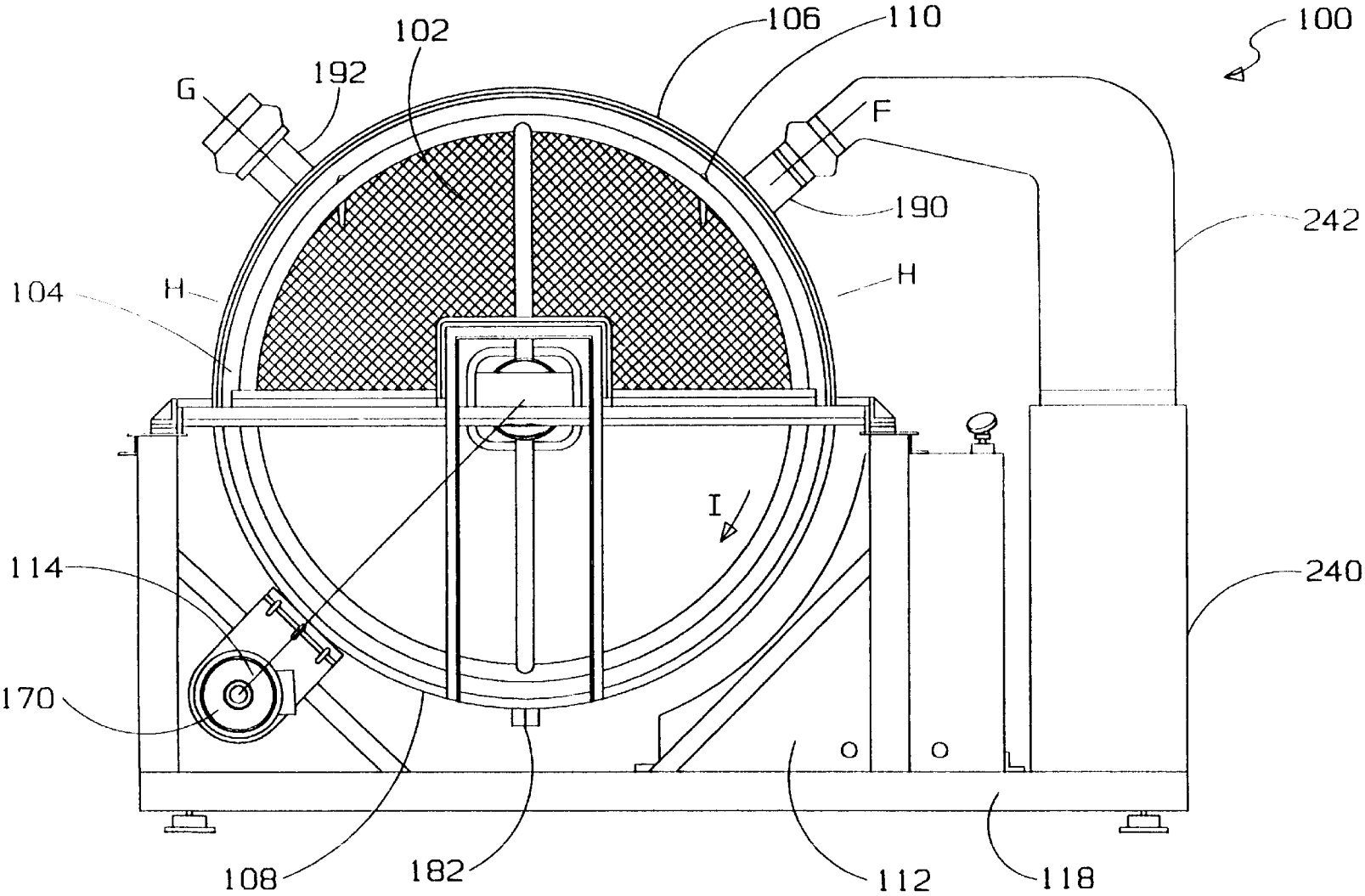
FIG. 7*a* is, in front elevation view, the machine of FIG. 6.
Figure 7B:
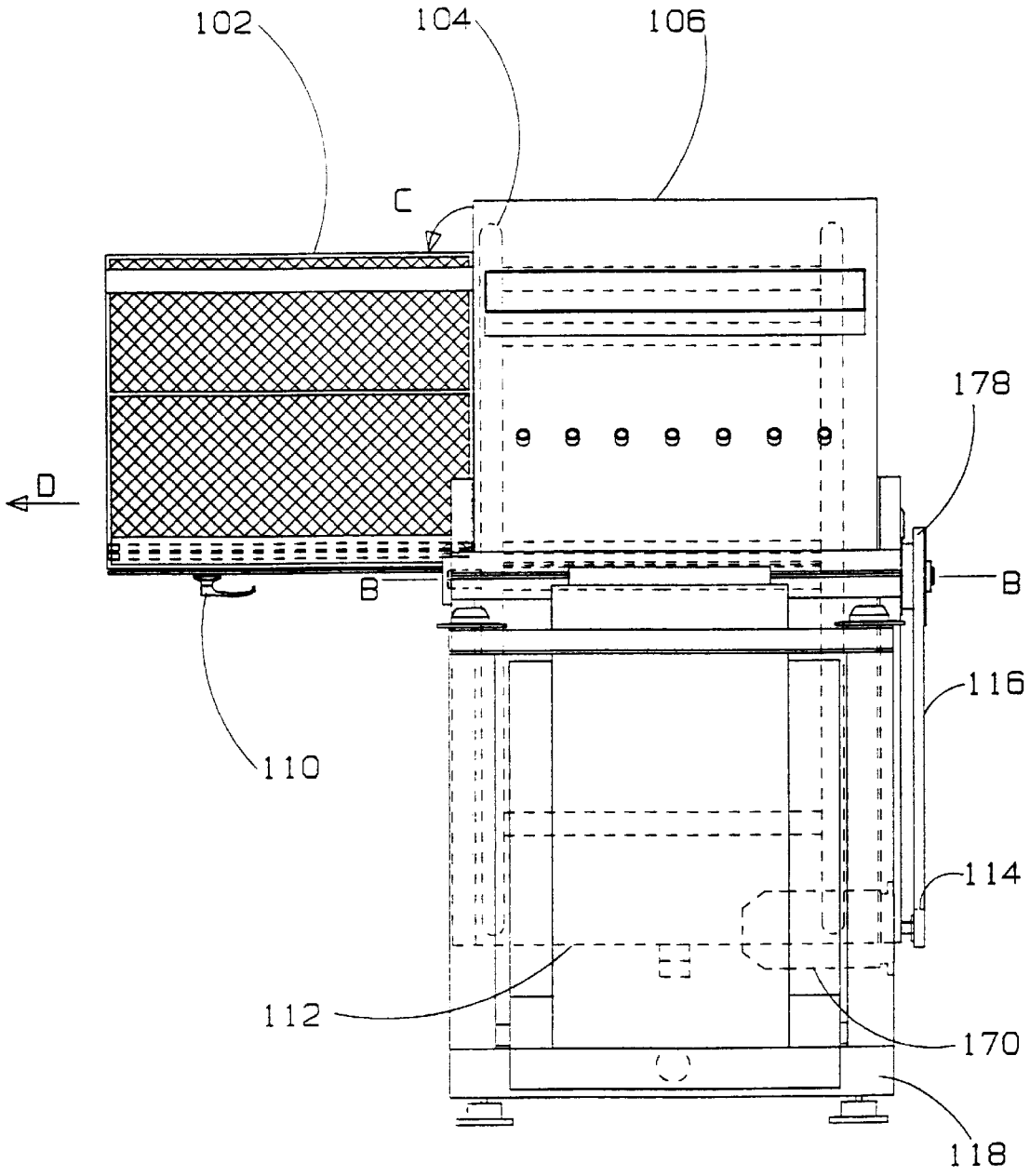
FIG. 7*b* is, in right side elevation view, the machine of FIG. 6.
Figure 7C:
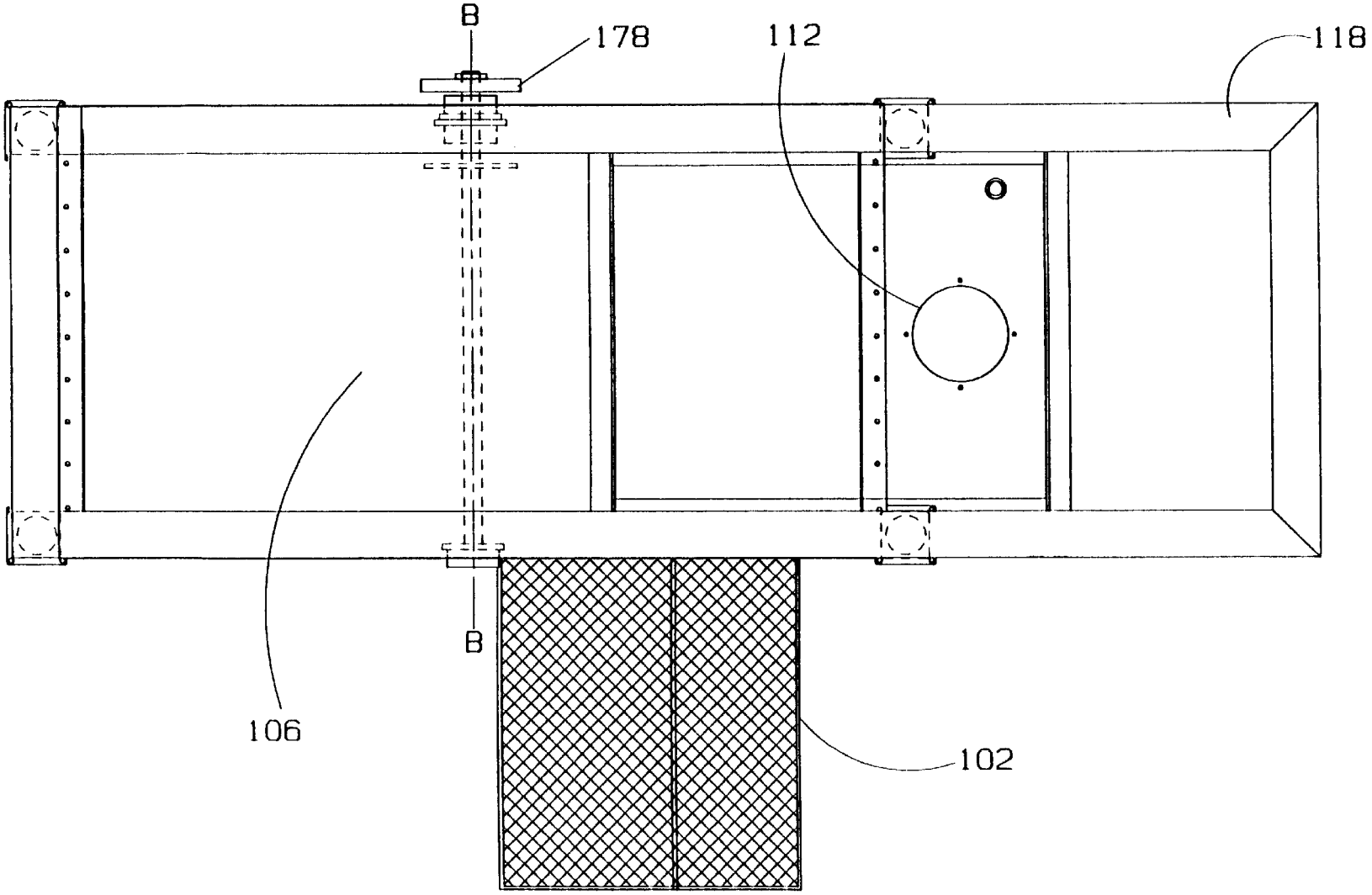
FIG. 7*c* s, in plan view, the machine of FIG. 6.

In a further alternative preferred embodiment, as seen starting in FIG. 6, the machine of the present invention is a combination washing and drying machine. Machine 100 employs a plurality of baskets 102 which are mounted within a cylindrically shaped caged 104. Baskets 102 are radially spaced in cage 104 about its axis of rotation B. Cage 104 is rotatably mounted so as to be free to turn about axis of rotation B within a cylindrical outer housing consisting of an upper tub 106 and a lower tub 108. Door 110 provides access into the front of upper tub 106. Door 110 is hinged to lower tub 108 and so may be folded down in direction C into its position shown in FIG. 7*b* which allows one or more baskets 102 to be telescopically slid outwardly in direction D from the interior of upper tub 106. This provides access to the interior of the basket or baskets as further described below. Water for use during the wash cycle is stored in a reservoir water tank 112. Motor drive 114 rotates cage 104 and baskets 102 within the housing during the wash and dry cycles, for example by means of a belt drive linkage 116. A frame assembly 118 provides the supporting structure for the components.

Figure 8A:
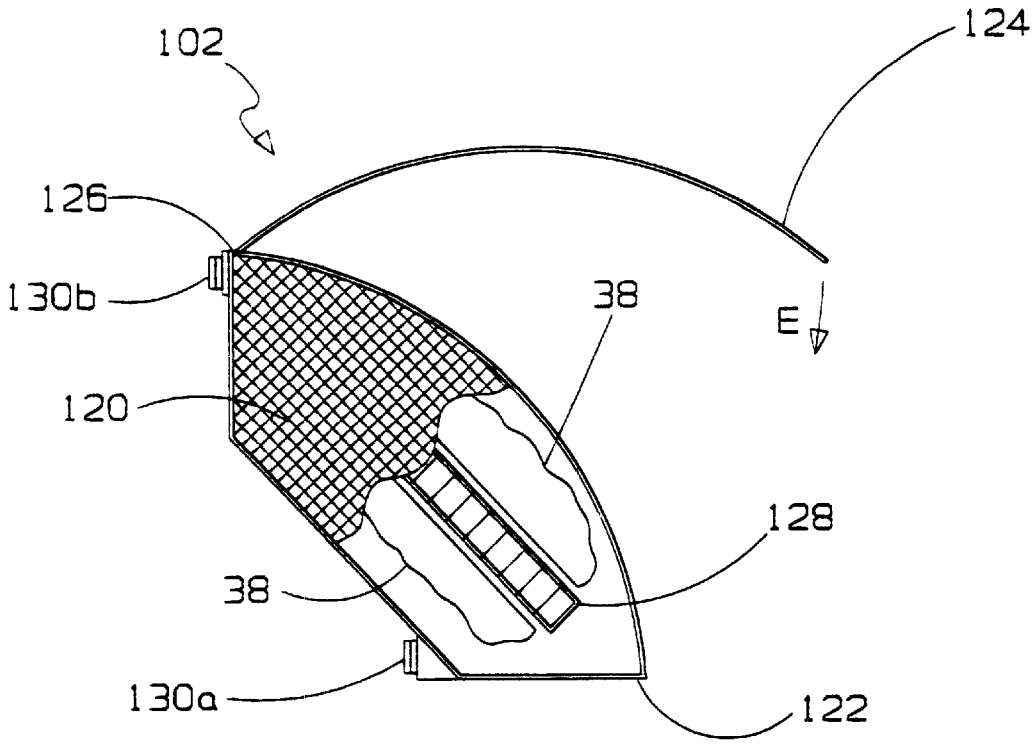
FIG. 8*a* is, in front elevation view, one basket of the machine of FIG. 6.
Figure 8C:
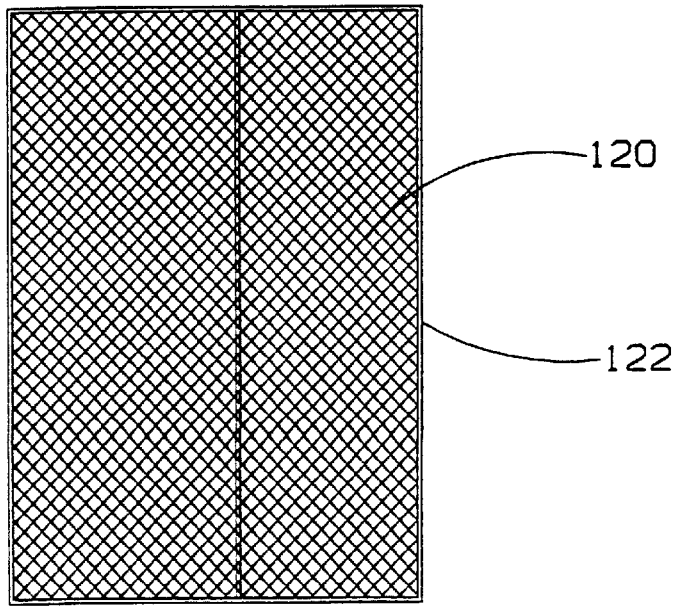
FIG. 8*c* is, in plan view, the basket of FIG. 8*a*.
Figure 8B:
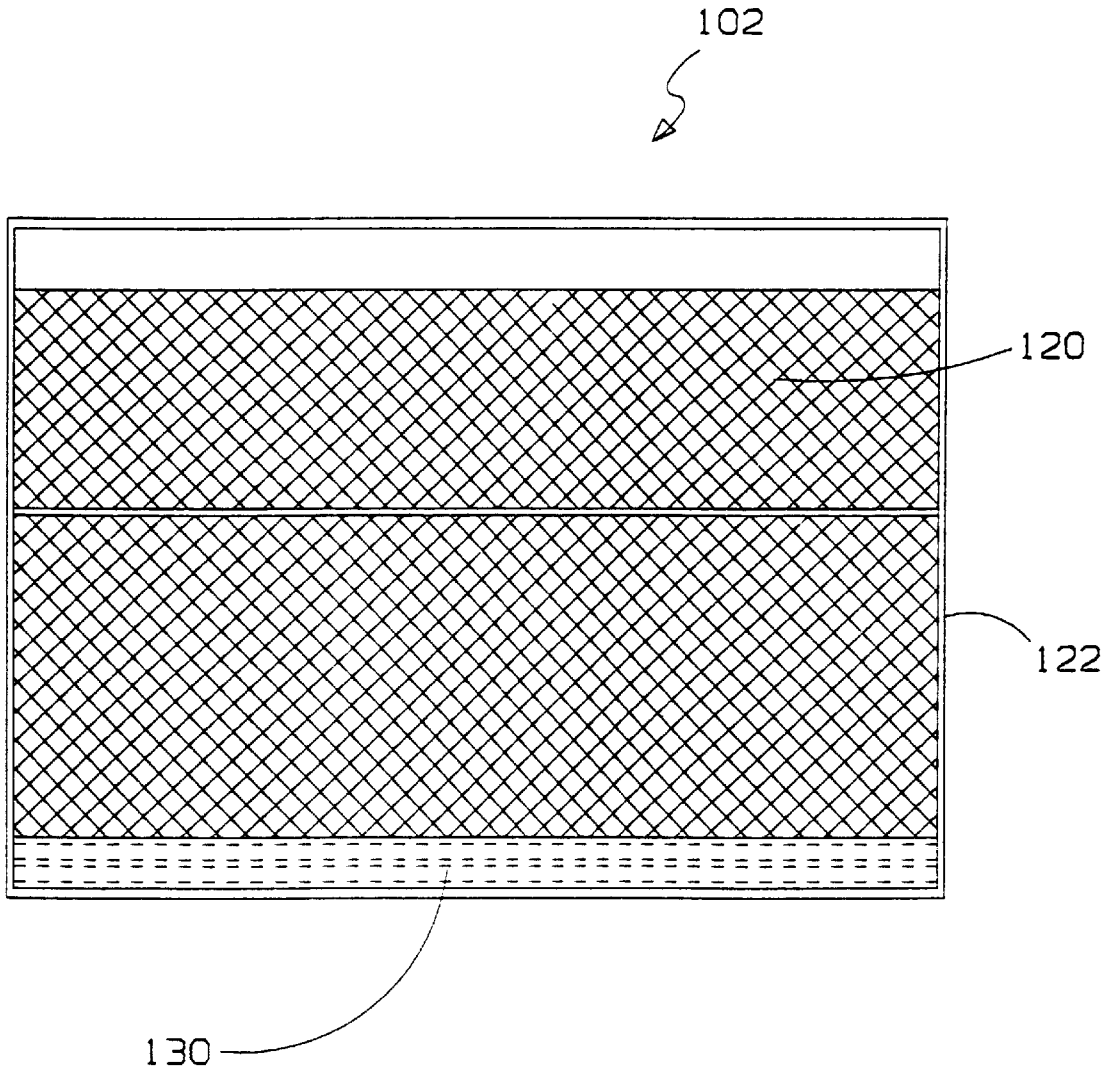
FIG. 8*b* is, in side elevation view, the basket of FIG. 8*a*.

As better seen in FIGS. 8*a*–8*c*, baskets 102 are advantageously each identical to one another, being constructed of an open weave mesh or the like, reference numeral 120 in the figures, rigidly mounted to rigid basket frame 122. Basket lid 124 also constructed of a mesh mounted within an outer frame, is mounted to basket frame 122 by means of hinges 126. Basket lid 124 may be closed in direction E and releasably fastened by means of clasps or the like in the closed position so as to enclose mesh equipment container 38 within the basket. Where the basket is sized so as to retain equipment container 38 in its folded position folded over about hinge 42, advantageously a rigid wire frame spacer 128 is placed between the folded over halves of equipment container 38 so as to allow the passage of water between the folded over halves.

Sliders 130 are rigidly mounted so as to face outwardly from one side of frame 122. Sliders 130 allow for the telescopic mounting of baskets 102 into cage 104.

Figure 9A:
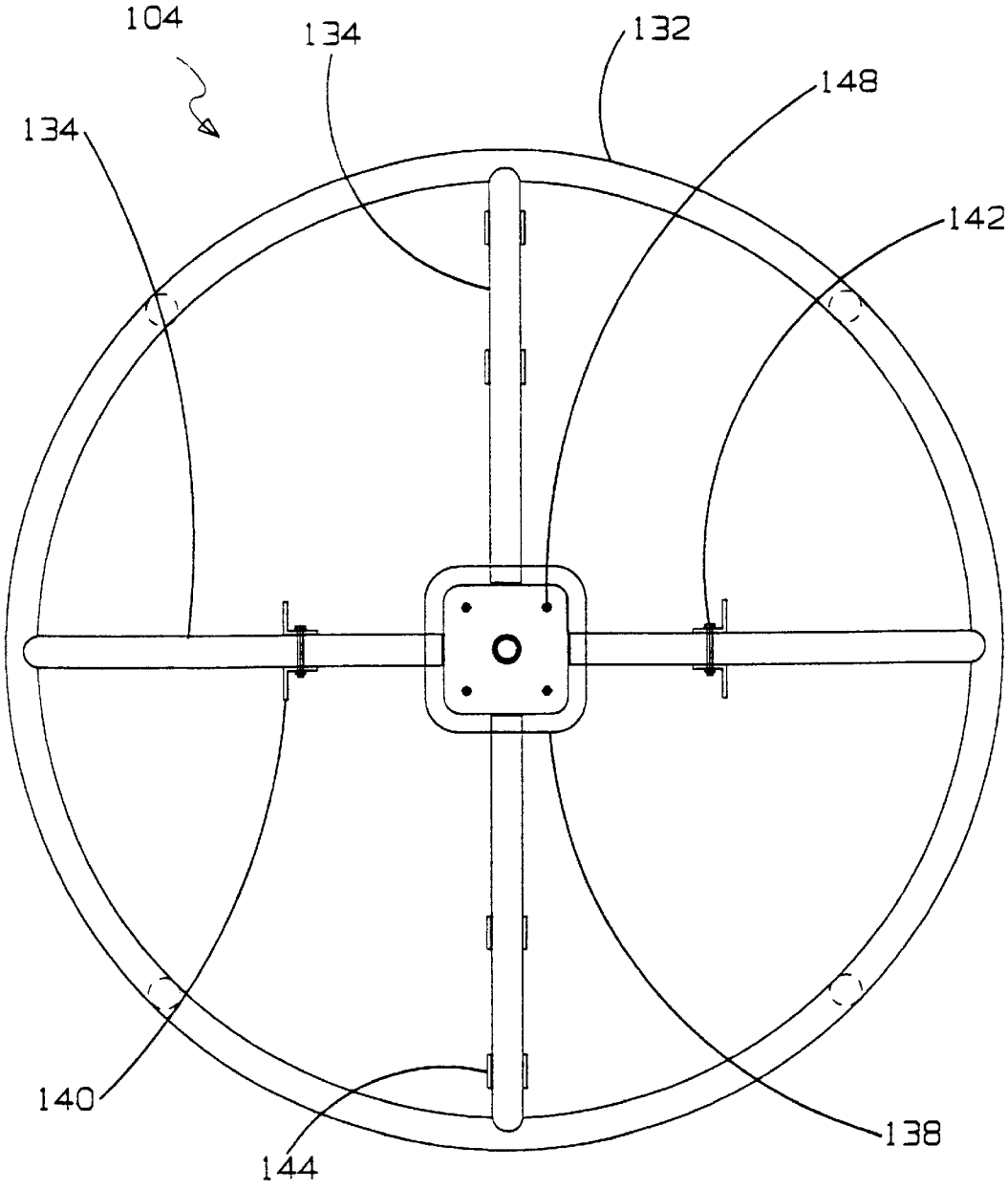
FIG. 9*a* is, in front elevation view, the cage of the machine of FIG. 6.
Figure 9B:
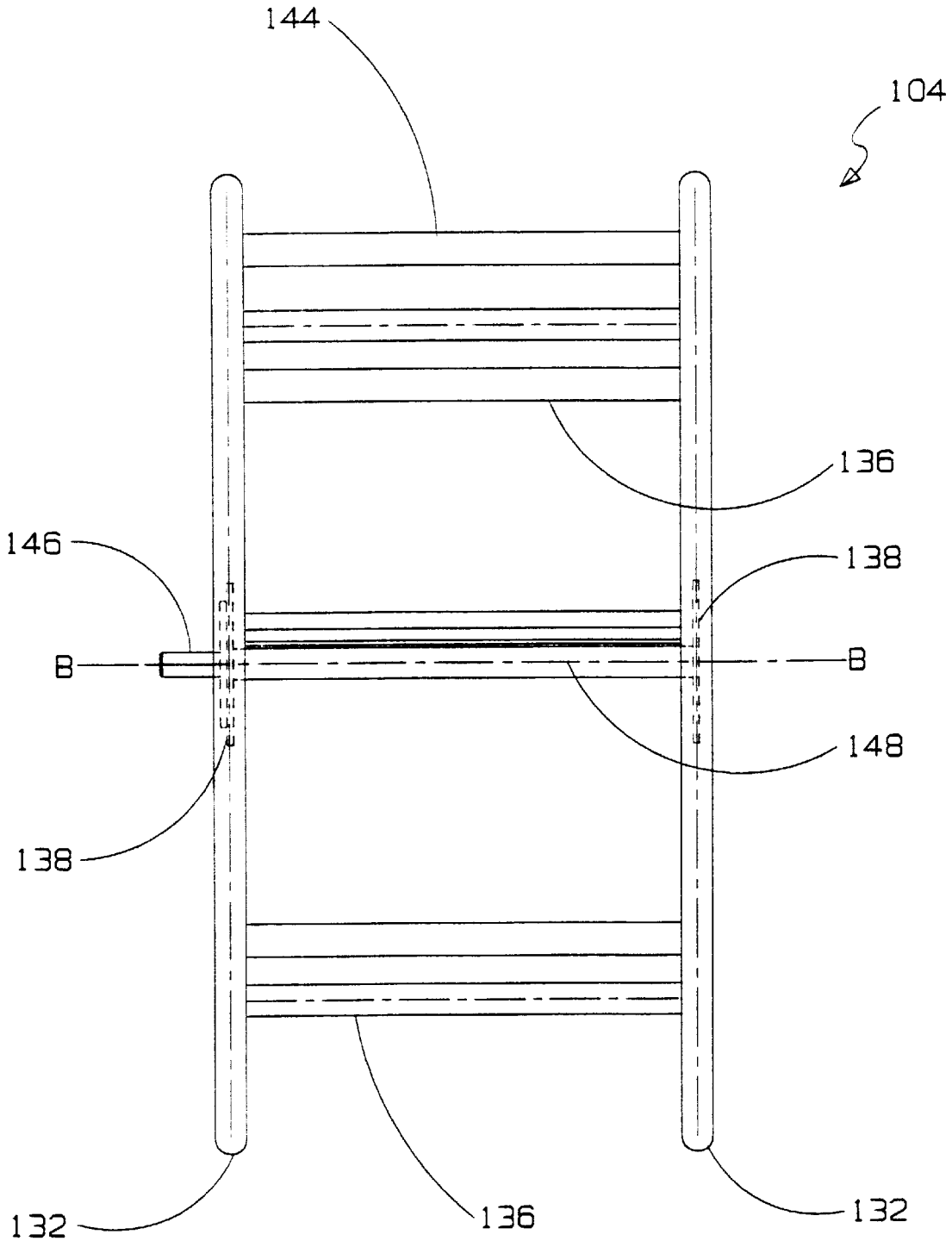
FIG. 9*b* is, in side elevation view, the cage of FIG. 9*a*.

As best seen in FIGS. 9*a* and 9*b*, cage 104 has rings 132 rigidly mounted to radial spokes 134. Rings 132 and spokes 134 are maintained in rigid parallel spaced apart relation by stringers 136. Center plates 138 are mounted rigidly at the intersection of the spokes. Stub shaft 146 is mounted to one of center plates 138 co-axially with axis of rotation B. Slider angle brackets 140 extend rigidly between the spokes parallel to axis of rotation B and center support 148. Slider plates 144 are mounted parallel to the stringers between rings 132.

Figure 10A:
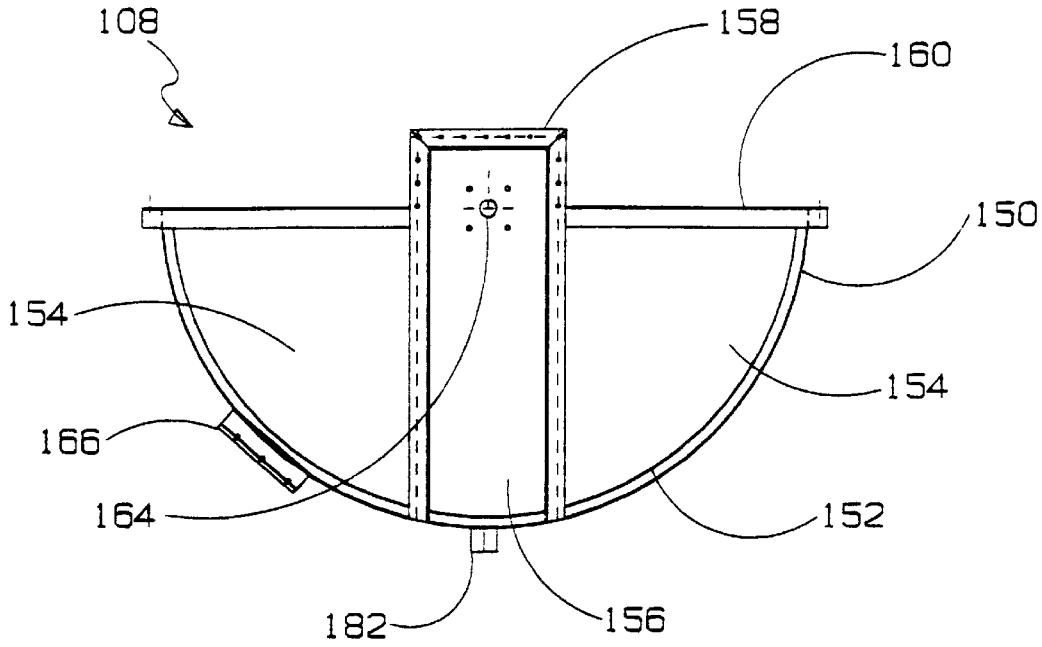
FIG. 10*a* is, in front elevation view, the lower tub of the machine of FIG. 6.
Figure 10C:
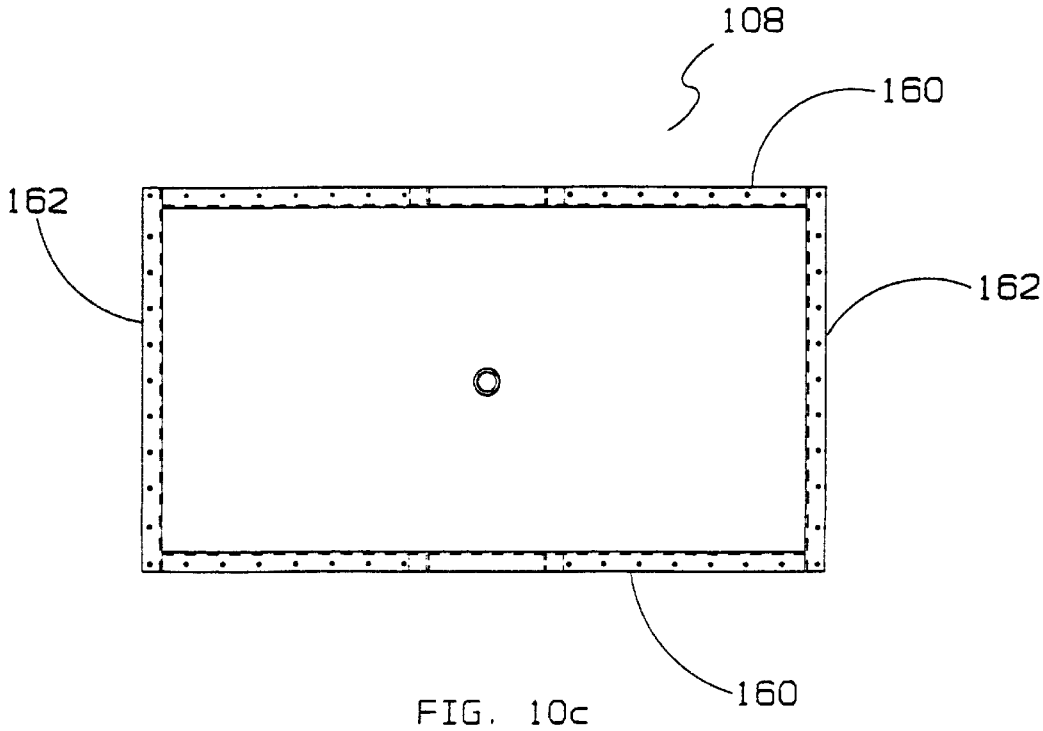
FIG. 10*c* is, in plan view, the lower tub of FIG. 10*a*.
Figure 10B:
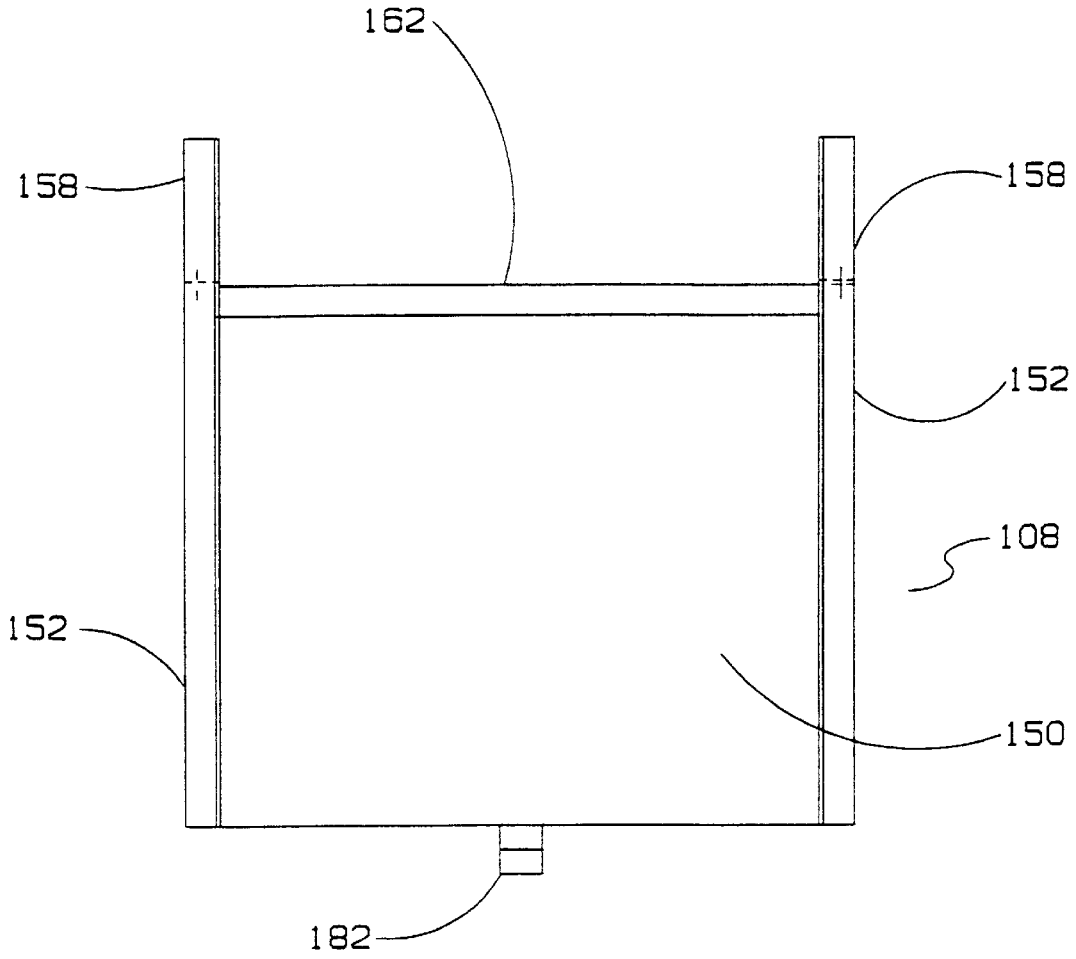
FIG. 10*b* is, in side elevation view, the lower tub of FIG. 10*a*.

As better seen in FIGS. 10*a*–10*c*, lower tub 108 has shell 150 rigidly mounted to stiffeners 152 so as to define, in cross section, a semi-circle. The front and back of shell 150, that is, between the interior of semi-circular stiffeners 152 is sealed by means of rigid plates 154 and 156. Rigid plates 156 are mounted within supporting stiffeners 158. Extending rigidly between the ends of stiffeners 152 are side angle members 160 and extending between the ends of the parallel adjacent stiffeners 152 across the upper edges of shell 150 are end angle members 162.

Plates 156 each have shaft apertures 164 formed therein for journalled mounting therethrough, through appropriate bearings, stub shaft 146 through one of the apertures and a drive shaft better described below through the opposite aperture. Motor mount 166 is mounted to one of stiffeners 152, so as to, for example, lay generally midway along one of the quadrants defined by stiffeners 152.

Figure 11B:
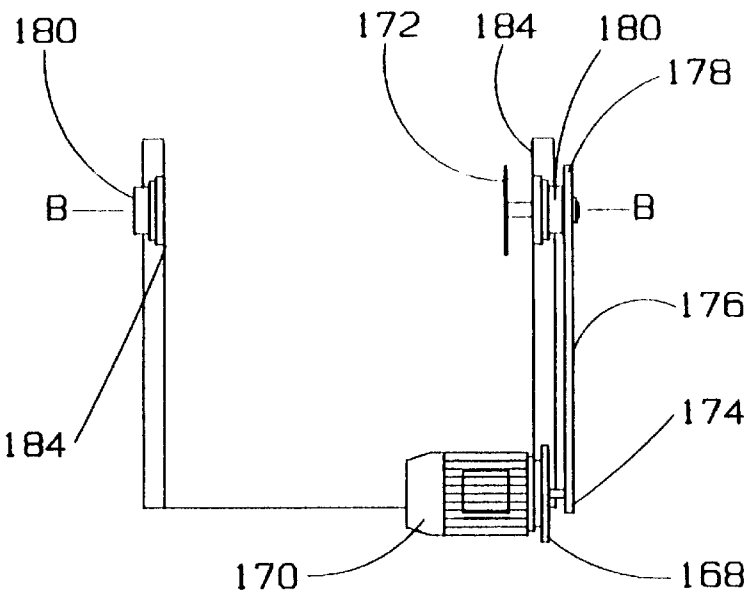
FIG. 11*b* is, in side elevation view, the drive motor and mount of FIG. 11*a*.
Figure 11A:
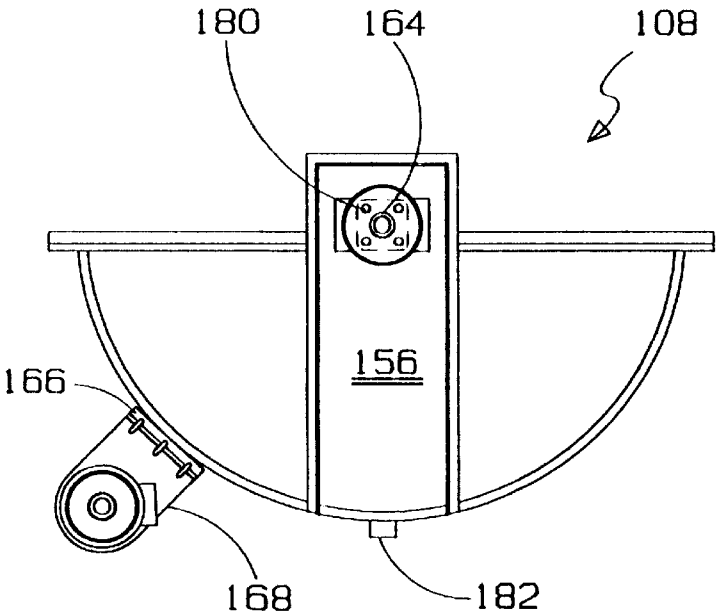
FIG. 11*a* is, in front elevation view, the drive motor and mount of the machine of FIG. 6.

As better seen in FIGS. 11*a* and 11*b*, motor mount flange 168 is rigidly mounted perpendicularly to motor mount 166. Drive motor 170, which is advantageously a reversible electric motor, is rigidly mounted to motor mount flange 168. Drive motor 170 may, for example be a Baldor™ No. VN3611T 3 horsepower reversible electric motor. Drive motor 170 drives rotation of drive shaft 172 via sheave 174, timing belt 176, and sheave 178. Drive shaft 172 and stub shaft 146 are rotatably mounted within apertures 164 by their respective flange bearings 180 mounted to plates 156. Spacers 184 are rigidly mounted to side walls 154 and the interior of lower tub 108 through which cage 104 rotates when driven by drive motor 170. In the preferred embodiment, spacers 184 are perforated so as to assist in trapping or at least in dampening the energy of spray within the housing so as to facilitate drainage through pipe coupling 182.

Lower tub 108 may be drained of water through pipe coupling 182.

As seen in FIGS. 12*a*–12*d,* upper tub 106 has a semi-circular shell 186 extending between end angle members 188. Inlet duct 190 and exhaust duct 192 are mounted onto shell 186 so as to provide a drying airflow into, and out of, the interior of the housing comprising the upper and lower tubs. Inlet duct 190 has corresponding inflow access F which intersects the outflow access G of exhaust duct 192 at the center of curvature of shell 186. Advantageously, inlet duct 190 and exhaust duct 192 open into upper tub 106 across substantially the entire depth of the tub. A large volume of hot air as better described below, may thus be blown into the interior of the housing through inlet duct 190 an extracted as moisture laden air through exhaust duct 192.

Shell 186 is also braced by means of side angle members 194. End plate 196 is rigidly mounted to the back of shell 186 so as to seal the back of upper tub 106. The front of shell 186 is sealed when door 110 is closed, for example so as to compress an arcuate resilient door seal member 198 between door 110 and door frame 200. In the embodiment illustrated, door 110 is of a substantially transparent material so that the interior of upper tub 106 may be viewed when door 110 is closed. Door seal 198 may be held in place by means of a door seal retainer 202.

Further apertures are also provided through shell 186 into which are mounted pipe couplings 204 which in one preferred embodiment are ½ inch NPT pipe couplings. Pipe couplings 204 may have longitudinal flow axes H which may also intersect the center of curvature of shell 186. Pipe couplings 204 provide for inlet nozzles for the pressurized injection of soapy water or rinse water during the washing cycle as better described below.

Figure 12A:
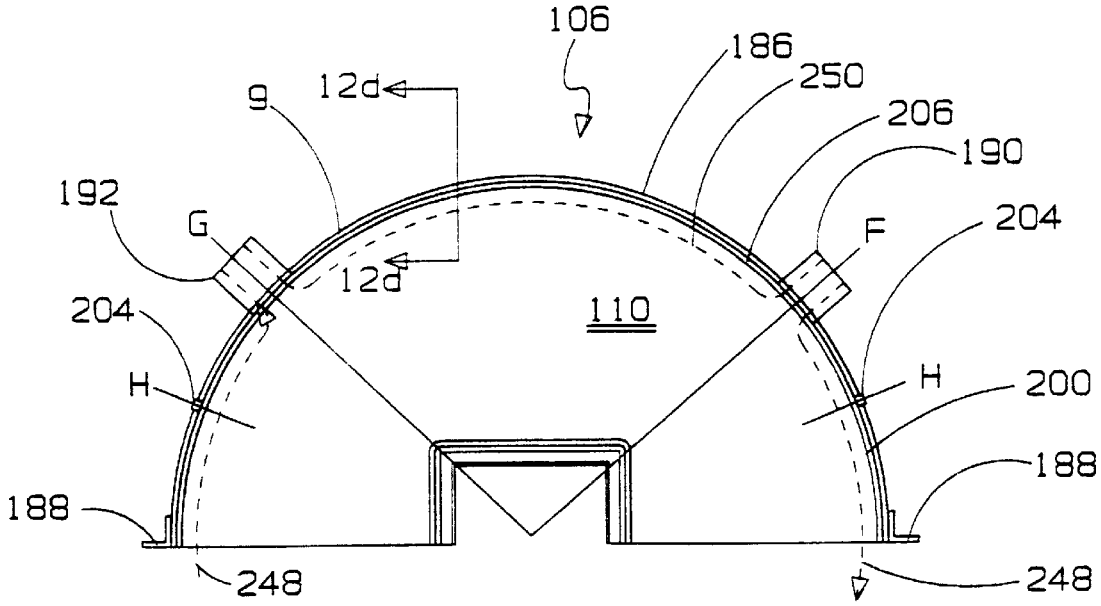
FIG. 12*a* is, in front elevation view, the upper tub of the machine of FIG. 6.
Figure 12C:
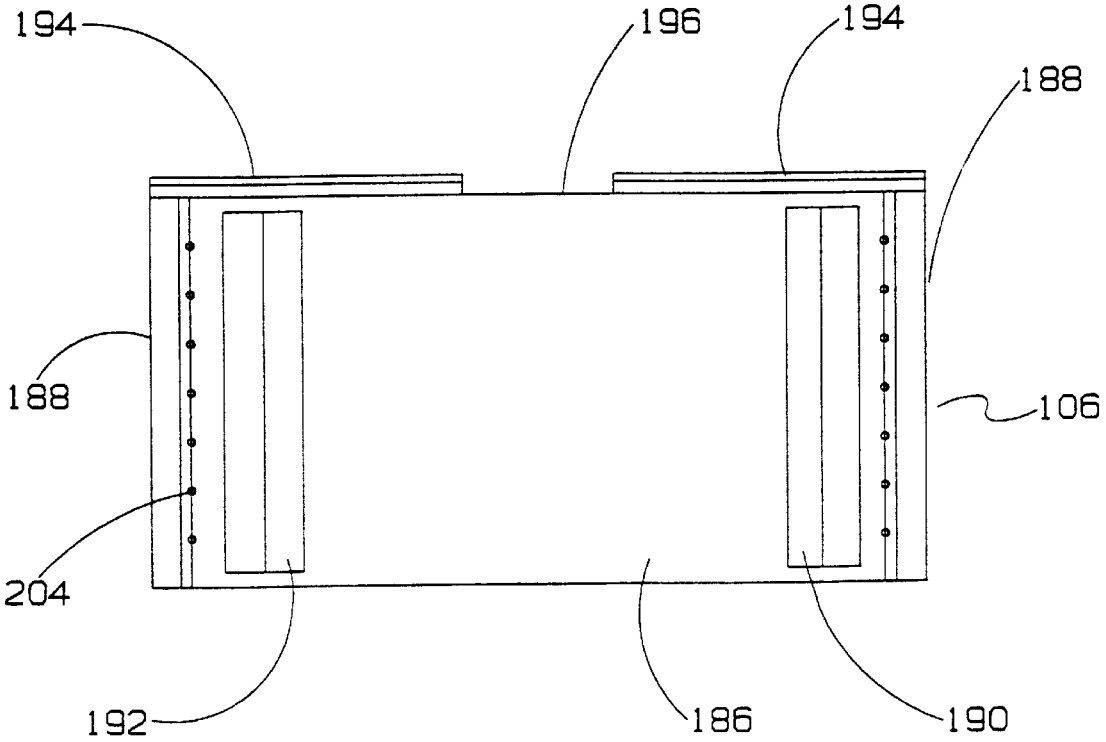
FIG. 12*c* is, in plan view, the upper tub of FIG. 12*a*.
Figure 12B:
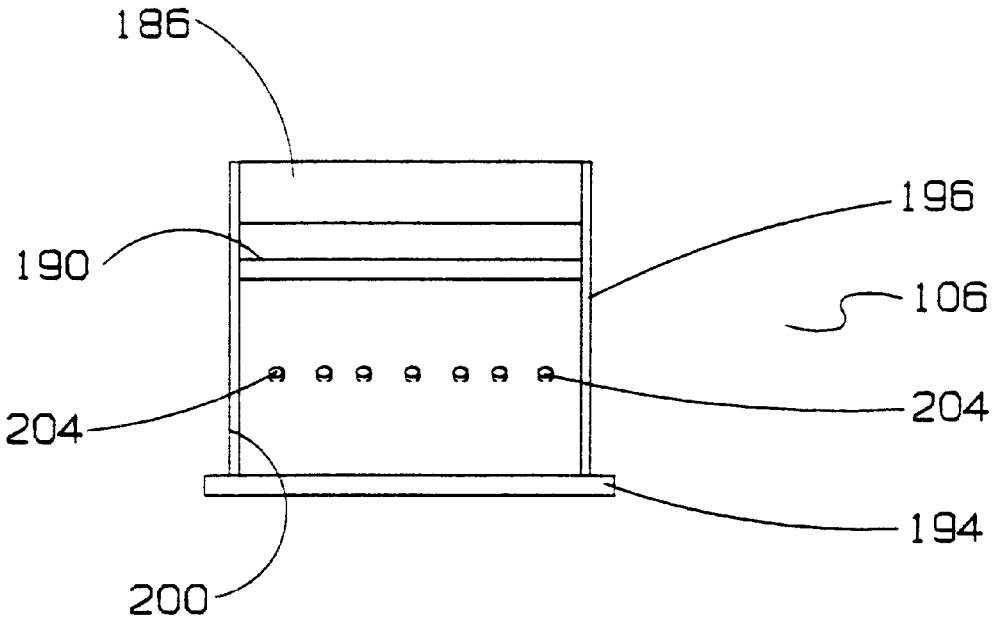
FIG. 12*b* is, in side elevation view, the upper tub of FIG. 12*a*.
Figure 12D:
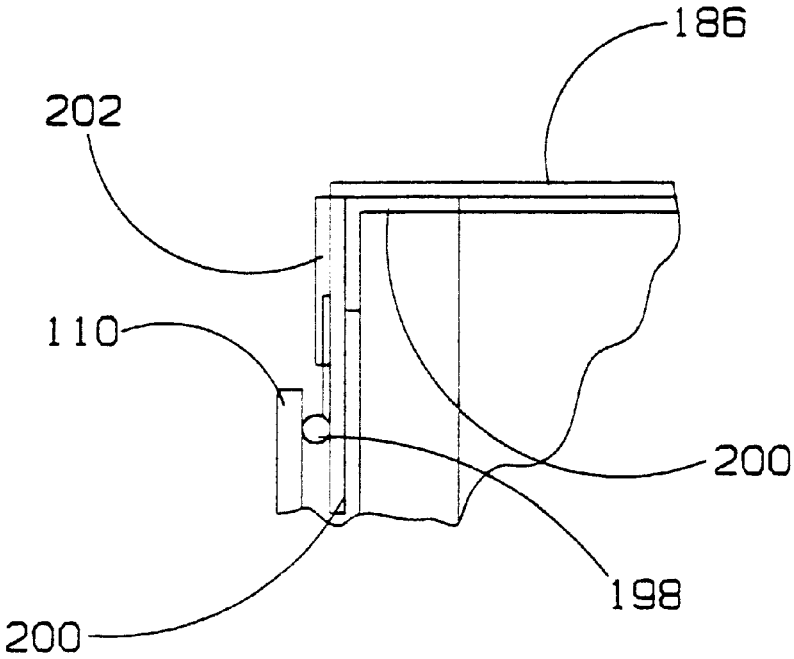
FIG. 12*d* is a sectional view along line 12*d*—12*d* in FIG. 12*a*.

As also seen in FIG. 12*a* a perforated splashguard 206 is mounted as a liner within shell 186 and provides for dampening of water spray within the tub, for example thrown from baskets 102 during the spin dry cycle.

Figure 13A:
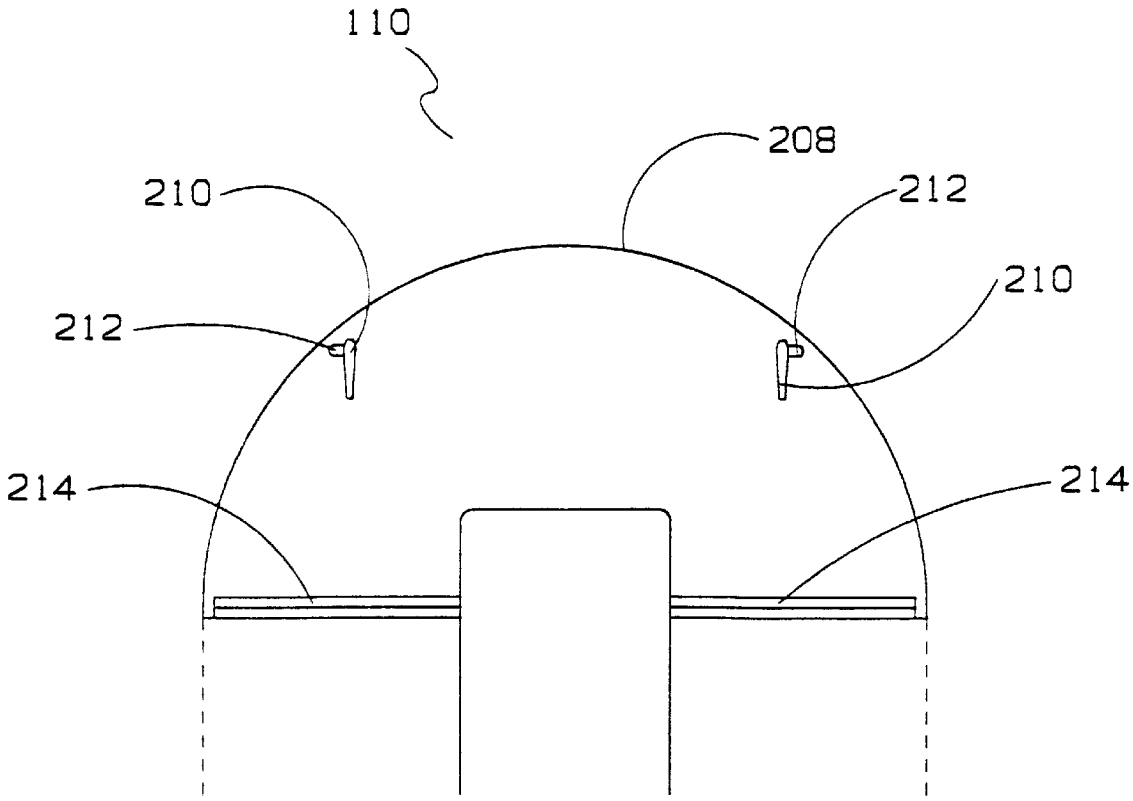
FIG. 13*a* is, in front elevation view, the door of the machine of FIG. 6.
Figure 13B:
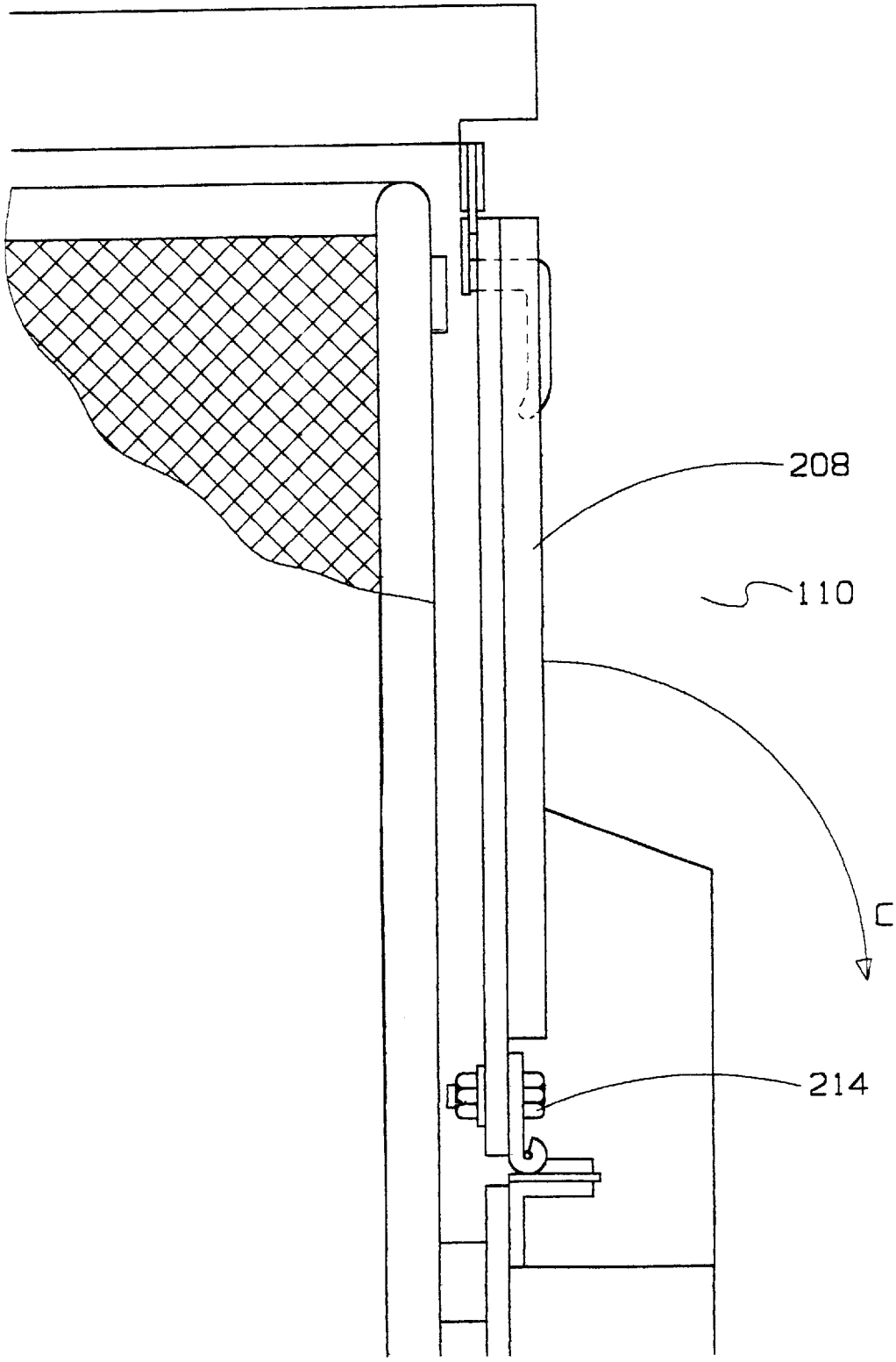
FIG. 13*b* is, in side elevation view, the door of FIG. 13*a*.

As better seen in FIGS. 13*a* and 13*d* door 110 may be a transparent sheet 208, for example a polycarbonate sheet of ¼ inch thickness preferably with a scratch resistant coating. Sheet 208 is releasably locked into its closed position against door frame 200 and corresponding door seals 202 by turning handles 210 so as to engage latches 212. With latches 212 disengaged from engagement with door frame 200, sheet 208 may be pivoted downwardly about hinges 214 in direction C into the door's open position so as to provide access into the upper tub.

Figure 14A:
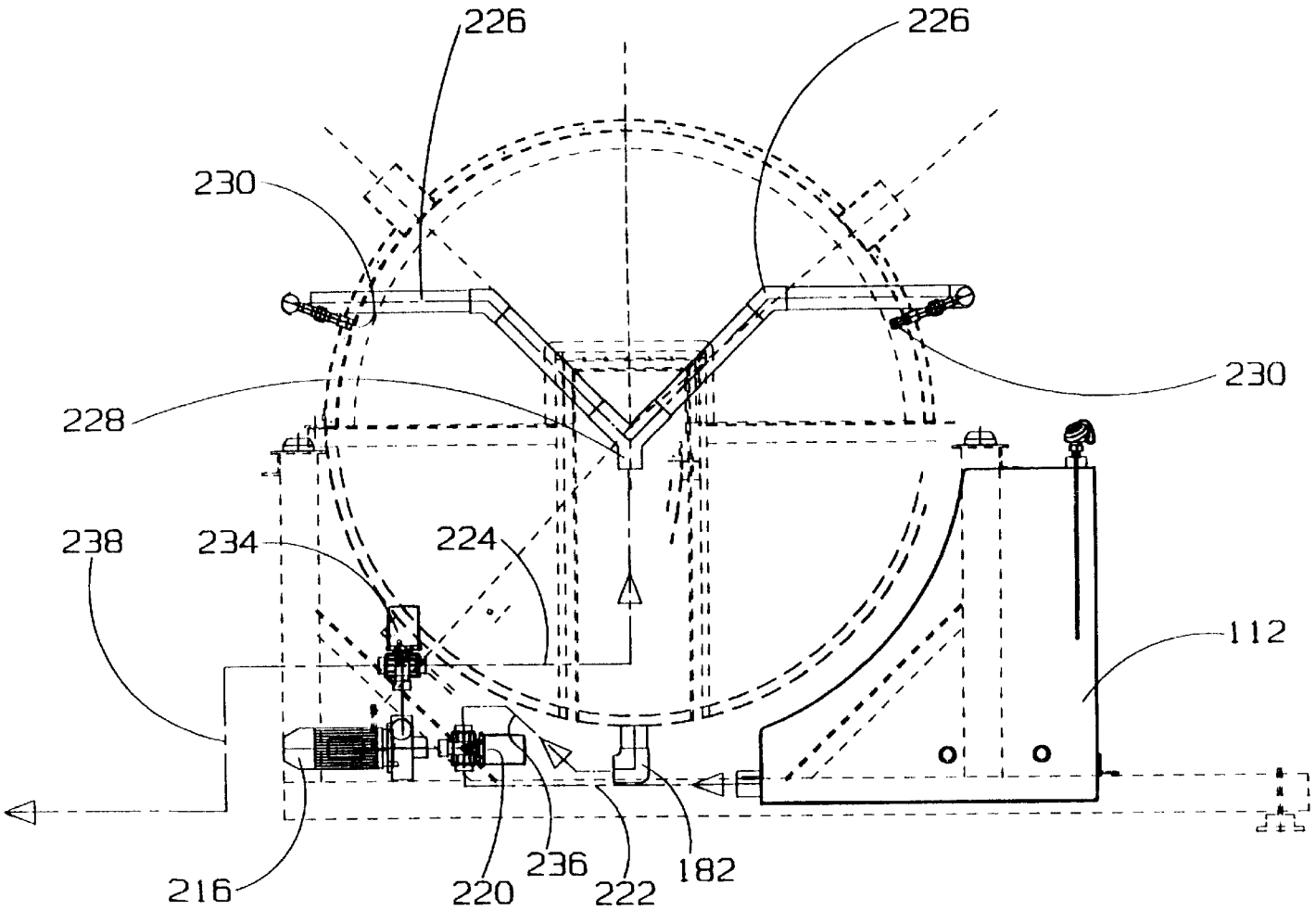
FIG. 14*a* is, in diagrammatic front elevation view, the water control system of the machine of FIG. 6.
Figure 14B:
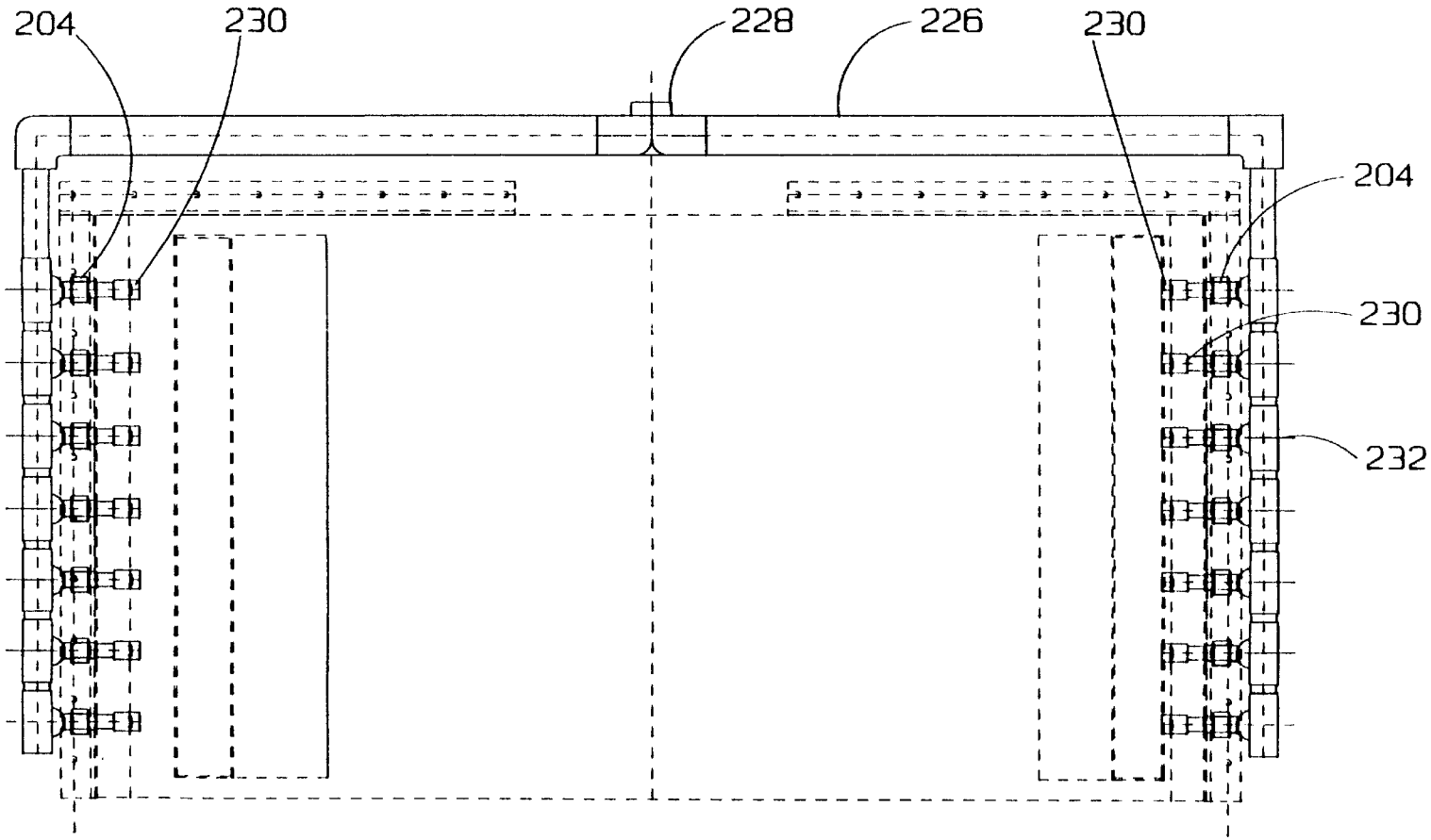
FIG. 14*b* is, in plan view, the spray nozzle water conduits of the water control system of FIG. 14*a*.
Figure 14C:
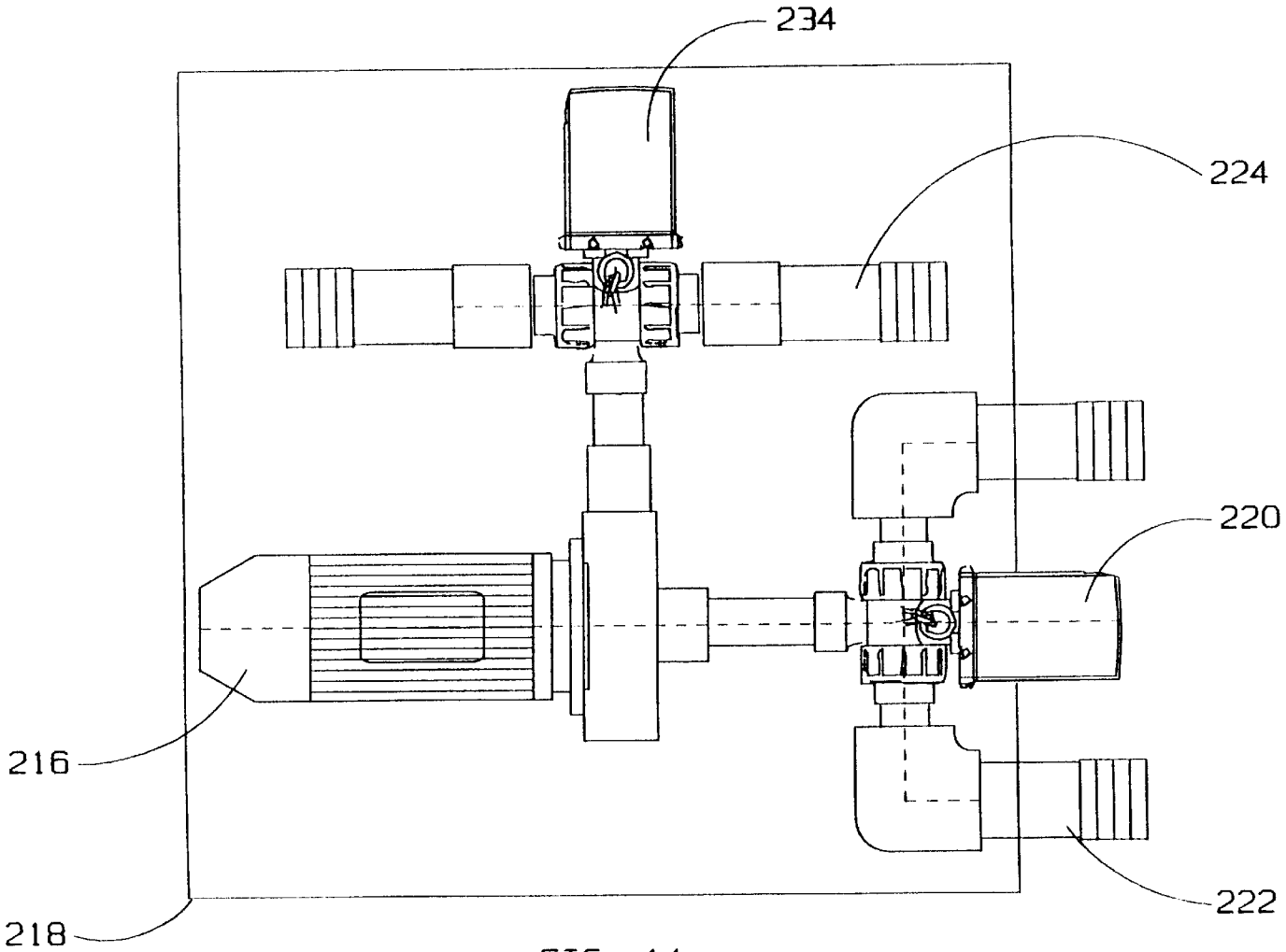
FIG. 14*c* is, in front elevation view, the water pump and valve arrangement of the water control system of FIG. 14*a*.

As seen in FIGS. 14*a*–14*c,* the control system of the present invention, programmed as would be known to one skilled in the art and user actuated by on/off switches 252 directs water from water tank reservoir 112, advantageously holding approximately 80 gallons, through jet pump 216 mounted to base plate 218, via electrically actuated control valve 220 and reservoir water line 222. Water is drawn from the reservoir and pumped by jet pump 216 through water line 224 and water conduits 226 via wide junction 228 so as to supply water to spray nozzles 230.

Spray nozzles 230 are mounted to pipe couplings 204 so as to project into the interior of upper tub 106 through splashguard 206. Water conduits 226 form a yoke having longitudinally extending arms extending across the depth of upper tub 106 so as to provide pressurized water flow to pipe couplings 204 via T couplings 232.

Water flow into water conduits 226 via water line 224 from jet pump 216 is controlled by electrically actuated valve 234. Once the contents of water tank reservoir 112 has been pumped into the tub housing, that is, the housing comprising the upper and lower tubs, valve 220 is actuating so as to close off water line 222 and open drain line 236. Drain line 236 drains water from drain pipe coupling 182, that is, from the bottom of lower tub 108. Thus either soapy water during the wash cycle or rinse water during the rinse cycle may be recycled into the tub by being pumped from the drain back up to the spray nozzles during both the wash and rinse cycles. Once each cycle has completed, it is then necessary to drain the tub, for example of either the wash water or the rinse water before the next sequential cycle may be commenced. This is accomplished by actuating valve 234 so as to redirect water being pumped from jet pump 216 from water line 224 to water discharge line 238. The timed actuation of valves 220 and 234 in conjunction with the cycling of motor drive 170 as better described below, is controlled by programmable logic controllers or the like such as would be known in the art. Thus as the wash cycle is progressing, once reservoir 112 has been depleted and water line 222 shut off by actuation of valve 220, reservoir 112 is replenished awaiting either a further wash cycle or a rinse cycle. Soap for the wash cycle may be introduced by various means, for example either manually or automatically using liquid detergent or dissolvable solid detergent injected into the tub or an infeed water line, for example by use of an automatic dissolvable cartridge-type solid detergent dispenser 244 such as sold under their trademark Prizm™ and manufactured by Sunburst Chemicals of Minneapolis, Minn., U.S.A. Dispenser 244 dispenses soap via feed line 246.

As an example of the wash cycle, although not intended to be limiting, drive motor 170 may rotate cage 104 and baskets 102 in a first rotational direction about axis B for two minutes and then sequentially reverse directions every two minutes thereafter until the wash cycle is complete, for example after a total of 9 or 10 minutes. The wash cycle is accomplished by spinning rotation as opposed to agitation style rotation. The soapy water is then pumped from the tub and either another wash cycle commenced with fresh soapy water or the rinse cycle commenced. The speed of rotation of cage 104 during the wash cycle is relatively low, for example 9 rpm. The speed of rotation of the cage during the rinse cycle may typically also be 9 rpm. During a spin dry cycle, however, the rotational speed of the cage is increased to at least 200 rpm so as to centrifugally force water radially outwardly from the articles contained in the baskets. The subsequent drying cycle is accomplished by forcing hot air into the tub while rotating the cage in direction I at 9 rpm. Cage 104 is rotated in direction I so as to draw the hot air being forced into the tub along axis F through inlet duct 190 around the longest circumferential path (labelled path 248 in FIG. 12*a*) within the tub between inlet duct 190 and exhaust duct 192. It has been found that otherwise, the hot air being forced through inlet duct 190, if cage 104 is being rotated in a direction counter to direction I, exits through exhaust duct 192 (i.e., along path 250) with a minimal drying effect on the contents of baskets 102.

Hot air is provided by furnace 240 through flume 242, for example at 2500 c.f.m. As would be known to one skilled in the art, the water in reservoir 112 may be supplied at or heated to a selectively controllable temperature (controlled by for example thermostat 254). The hot air being forced through inlet duct 190 would also be supplied at a selectively controllable temperature by the furnace.

Figure 15:
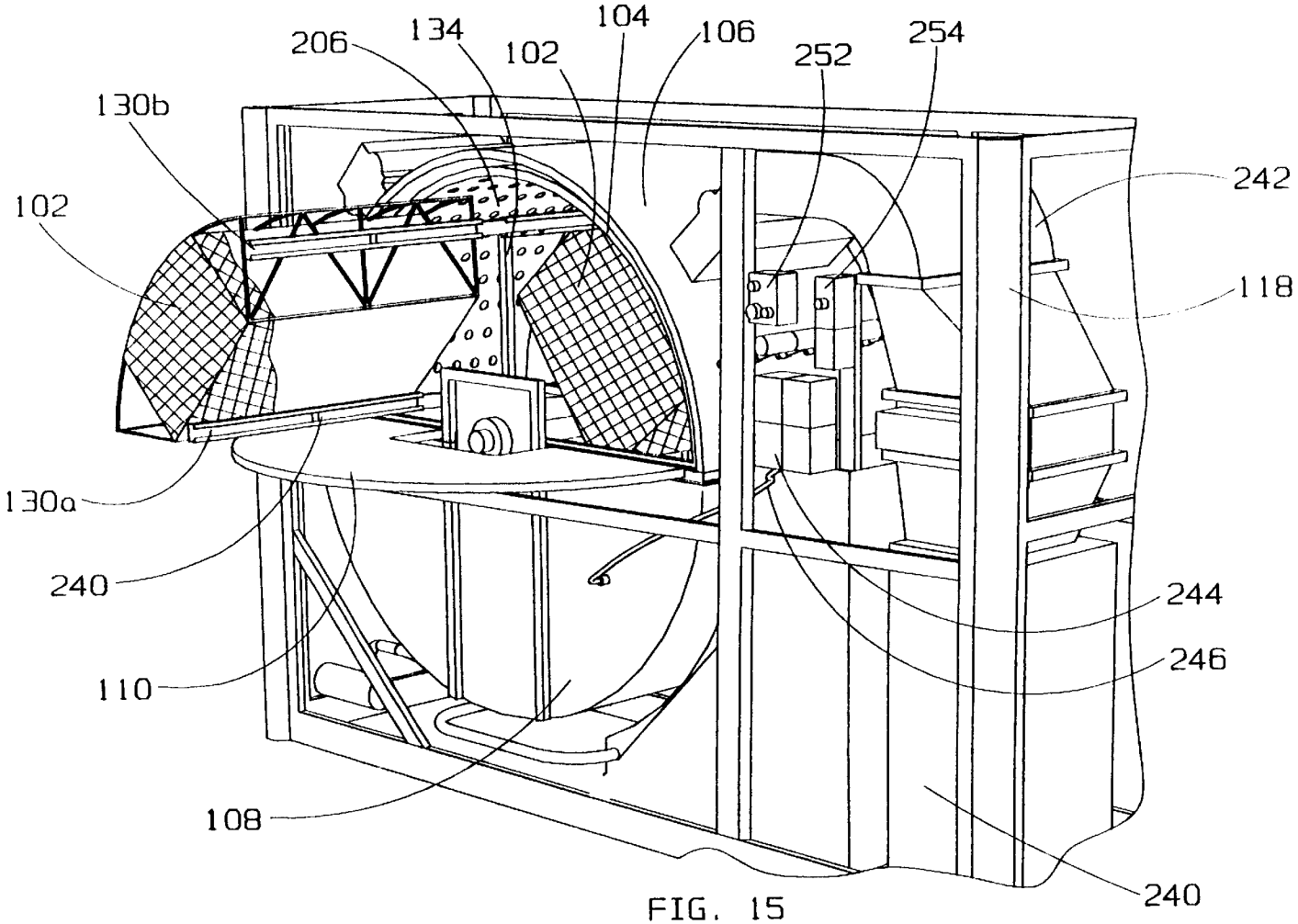
FIG. 15 is, in right side perspective view, the machine of FIG. 6 with the door open and a basket slid outwardly from the cage.
Figure 16:
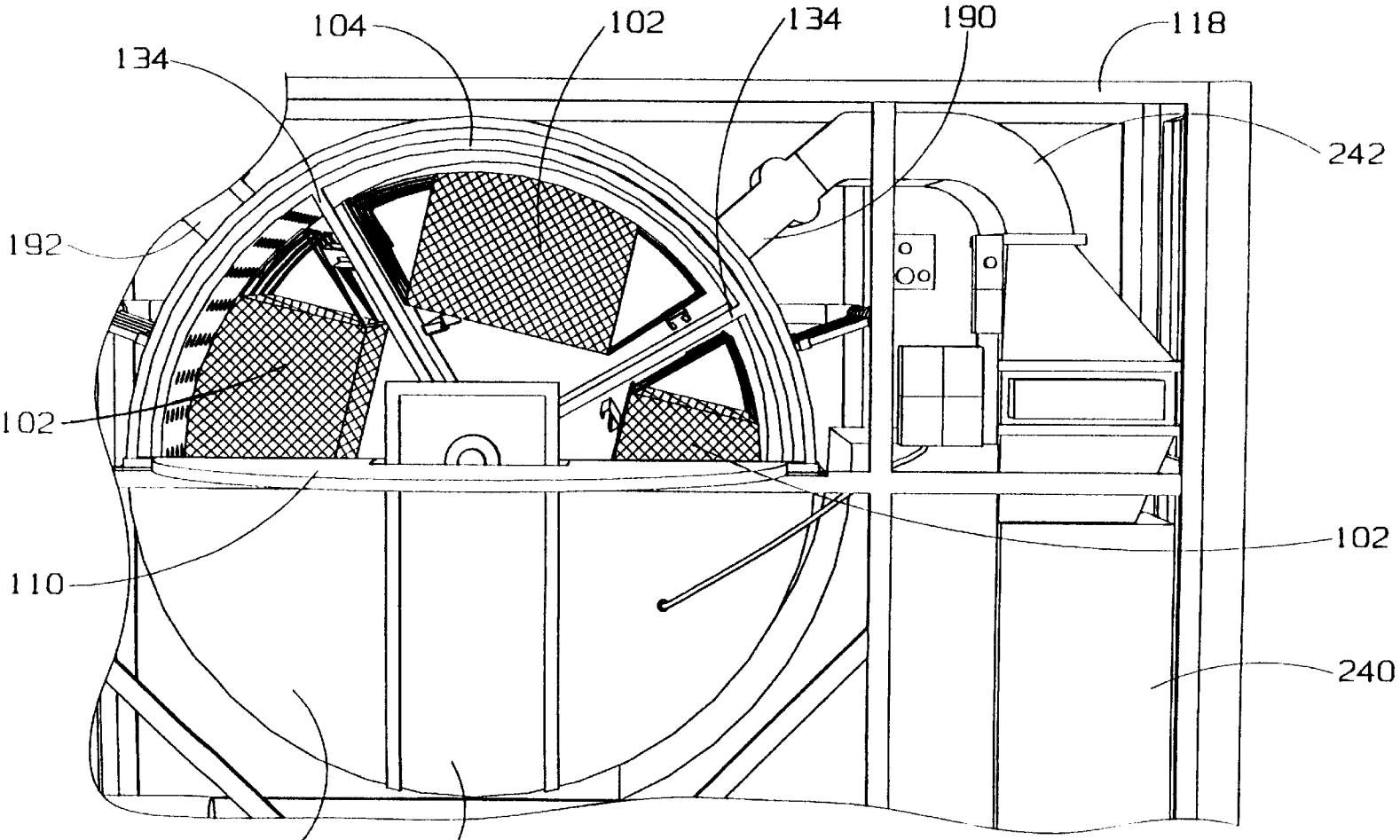
FIG. 16 is, in front elevation view, the machine of FIG. 15, with the door open.
Figure 17:
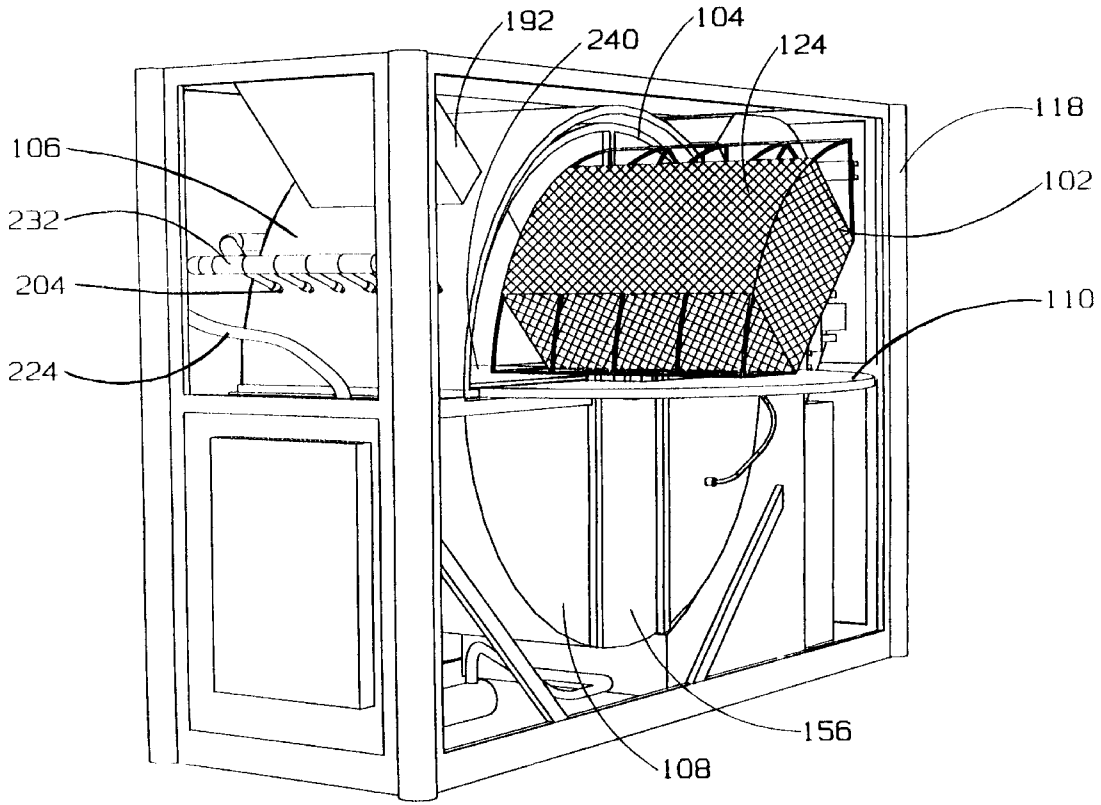
FIG. 17 is, in left side perspective view, the machine of FIG. 15.
Figure 18:
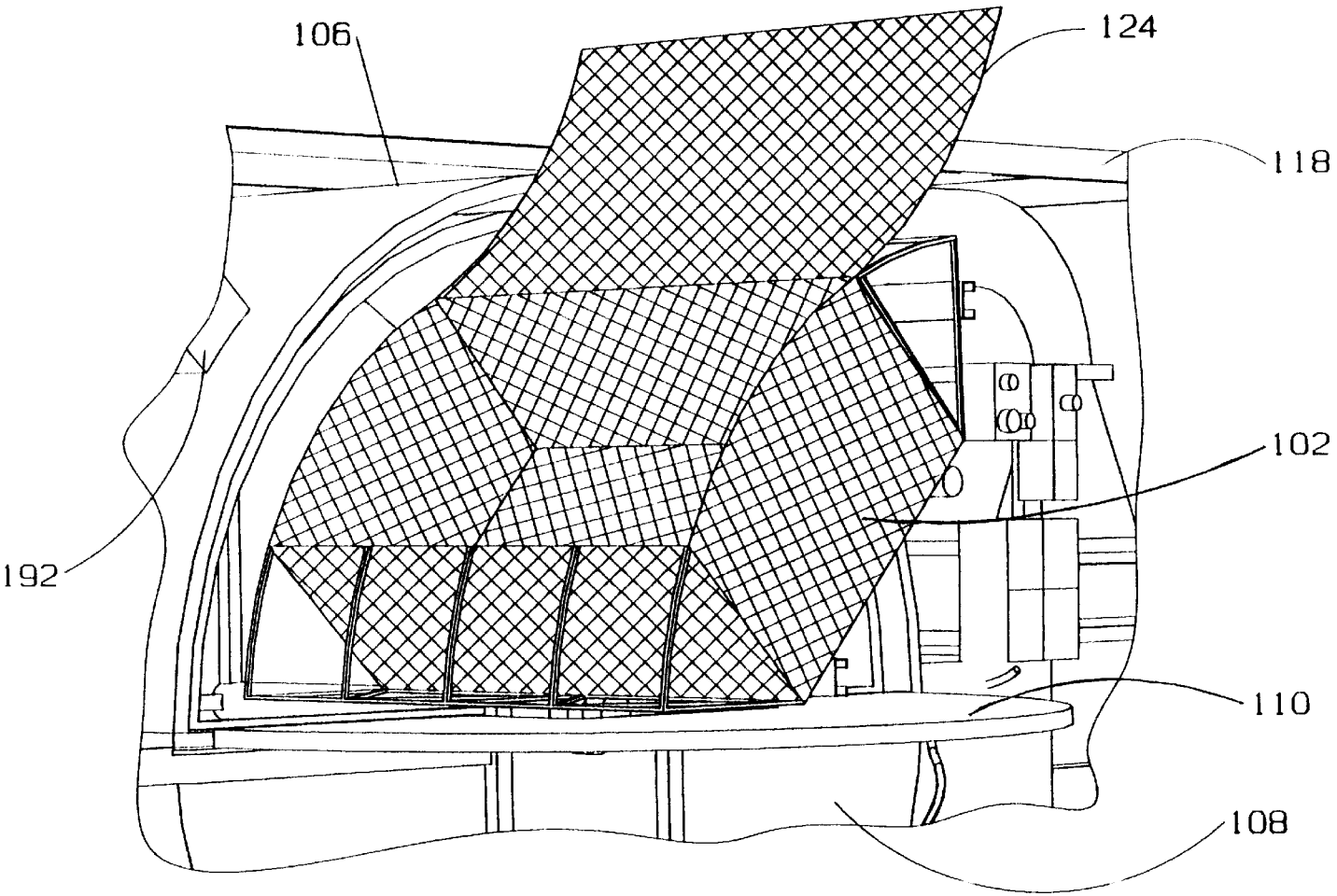
FIG. 18 is an enlarged view of the basket of FIG. 17 with the basket lid open.
Figure 19:
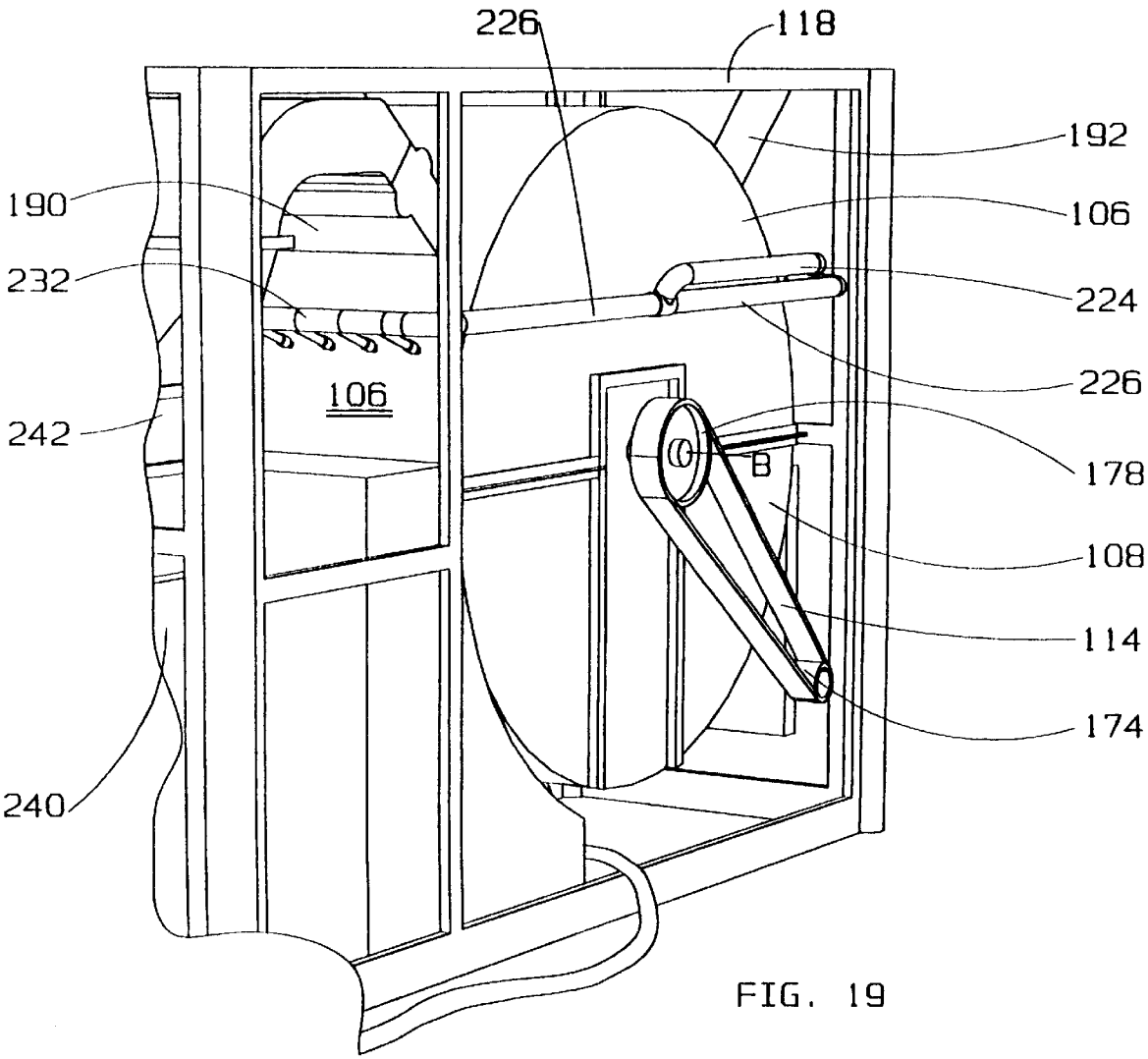
FIG. 19 is, in right rear perspective view, the machine of FIG. 15.
Figure 20:
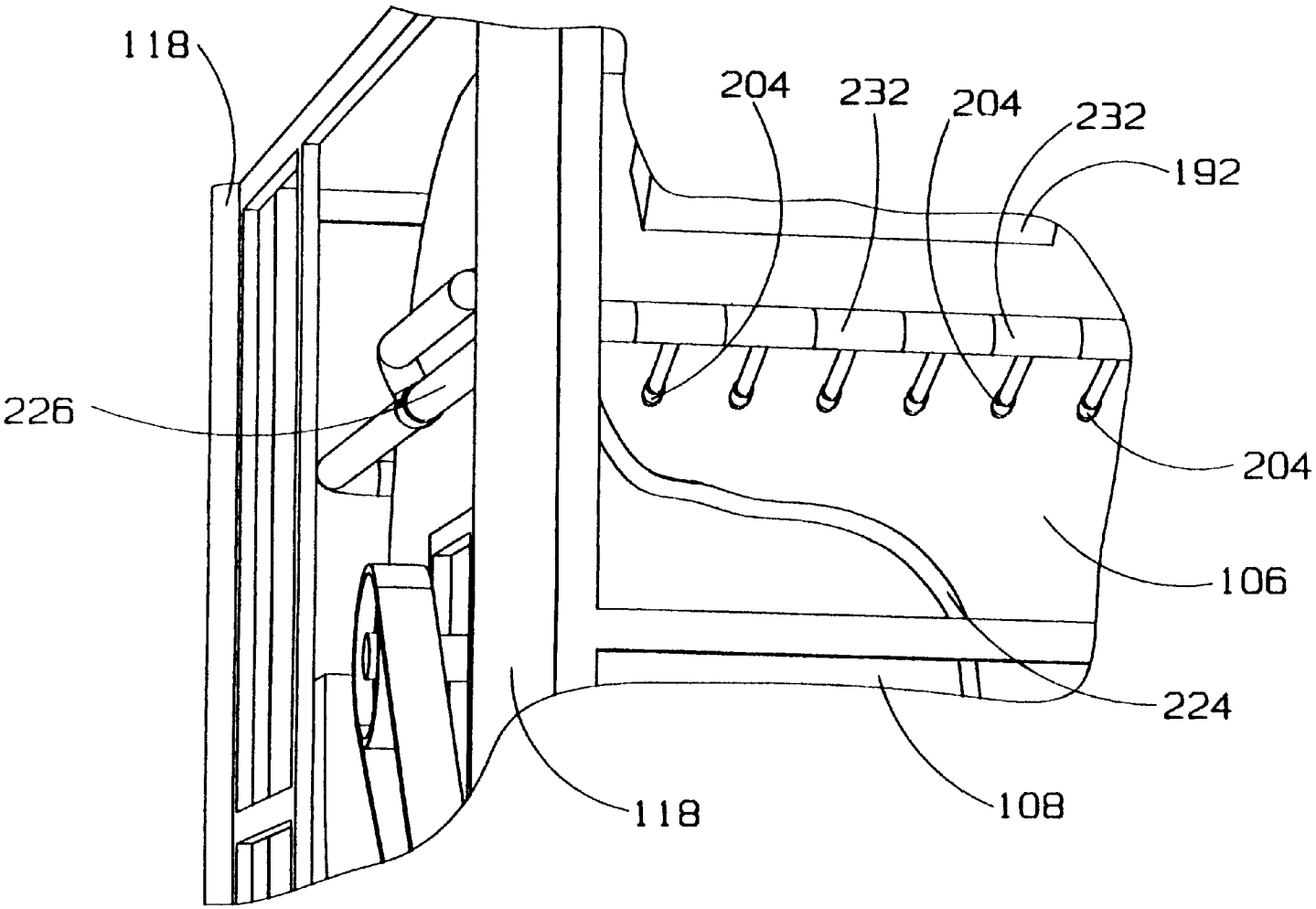
FIG. 20 is an enlarged view in left rear perspective view of the upper tub and spray nozzles of the machine of FIG. 15.

As seen in FIG. 15, baskets 102 telescope outwardly from cage 104 by means of sliders 130*a* telescopically sliding along telescopic members 240. In the preferred embodiment, telescopic members 240 are oblong blocks of ultra-high molecular weight (UHMW) polyethylene slidably mounted along one side thereof to sliders 130*a* on baskets 102 and slidably mounted on their opposite sides to slider angle brackets 140. Sliders 130*b* slidably engage slider plates 144.

As will be apparent to those skilled in the art in the light of the foregoing disclosures, many alterations and modifications are possible in the practice of this invention without departing from the spirit or scope thereof. Accordingly, the scope of the invention is to be construed in accordance with the substance defined by the following claims. In particular it would be recognized by those skilled in the art that the washing and drying machine of the present invention is not to be restricted to sporting equipment which in the past has been difficult if not impossible to clean such as helmets, body armor, ski boots with or without the liner removed, but also applies to many other articles that are generally difficult if not impossible to clean without having to be washed by hand. Thus, for example the machine of the present invention may be applied to the washing of fire-fighter suits, flight suits, tents, equestrian equipment, bulky fabrics, backpacks, cloth carriers for bulletproof vests, military and army body armor, harnesses used for lifting the disabled and elderly from beds or wheelchairs, and includes generally any other article which requires the use of an abundance of hook and loop fasteners which if placed in a conventional washing machine would become balled or knotted due to tumbling.

Agitation by conventional agitators it has been found in many articles causes damage to the articles. Such includes the padding coming out of sports equipment, or the fabric becoming entangled and jammed and the agitator wears on the material or tears the fabric. Further, such articles make an easily unbalanced load during the spin cycle.

It would be recognized then that many soft or flexible articles may be placed into the baskets of the present invention, whether or not the articles are contained within a mesh bag as taught or the like, and once so held within the baskets, so as to be held relatively stationary relative to the cage, are rotated within the tub in contra-distinction to merely being placed into a tub and agitated.

What is claimed is:

1. A device for washing flexible articles of apparel comprising;

a housing, a tub rigidly mounted to said housing, a basket rotatably mounted inside said tub for rotation of said basket about an axis of rotation, a basket rotation means mounted to said basket and actuable to rotate said basket during washing, rinsing and spin-drying cycles, a water supply and draining means cooperating with said tub for washing and rinsing said articles of apparel held in said basket, wherein said basket is an open-lattice sided container having a releasably closable lid and wherein said basket is, by means for securing said articles in said basket, adapted for both holding skill articles of apparel substantially stationary relative to said basket and separated in said basket during said washing and rinsing cycles and during centrifugal spin-drying cycle, and for allowing penetration of water from said water supply throghout said articles of apparel as said basket is rotated relative to said tub, wherein said means for securing said flexible articles in each basket includes an equipment container having separate compartments, said equipment container mountable into said basket for holding said articles of apparel generally individually separated from each other during said washing, rinsing and spin-drying cycles, and wherein during said centrifugal spin-drying of said articles of apparel during said spin-drying cycle, said basket is rotatable within said tub about said axis of rotation at a rotational speed sufficient to centrifugally force water from said articles.

2. The device of claim 1 wherein said equipment container is a mesh bag for holding said apparel, said mesh bag removably securable within said basket.

3. The device of claim 2 wherein said mesh bag is compartmentalized for simultaneously holding in spaced apart array various articles of said articles of apparel in said mesh bags when held in said basket.

4. The device of claim 3 wherein said mesh bag includes a main compartment of a generally rectangular parallelepiped shape mountable into said basket so as to lay said mesh bag flat in said basket.

5. The device of claim 4 wherein said basket is sized so as to fit therein when said mesh bag is folded in half and laid flat, and wherein said basket further comprises a rigid open-lattice spacer positionable between folded-over halves of said mesh bag.

6. A washing and drying device for flexible articles comprising, a watertight housing, a rotatable frame rotatably mounted within said housing for rotation of said frame about an axis of rotation, a plurality of water porous baskets mounted to said frame, each basket in said plurality of water porous baskets having a releasably securable lid mounted thereto, each said basket including, a means for securing said flexible articles in each said basket so as to both releasably hold said articles substantially stationary relative to said basket as said frame is rotated relative to said housing during washing, rinsing and centrifugal spin-drying of said articles and for allowing penetration of water from said water supply throughout said articles, a selectively controllable drive for rotating said frame relative to said housing, a wash water supply and drain cooperating with said housing for, respectively, pressurized supply of wash water into contact with said plurality of water porous baskets within said housing and draining said wash water, wherein said means for securing said flexible articles in each said basket includes an equipment container having separate compartments, said equipment container mountable into said basket, said compartments for holding said articles of apparel stationary relative to said basket and for holding said articles of apparel generally individually separated from each other during said washing, rinsing and spin-drying cycles, wherein during said centrifugal spin-drying of said articles said rotatable frame is rotatable within said housing at a rotational speed sufficient to centrifugally force water from said articles.

7. The device of claim 6 further comprising a forced air dryer mounted to said housing for drying said articles in said plurality of water porous baskets as said plurality of water porous baskets are rotated on said frame relative to said housing, said forced air dryer having an inlet mounted to said housing at a first position on said housing, and an exhaust outlet mounted to said housing at a second position on said housing, said second position radially spaced from said first position about said axis of rotation so that, when rotated about said axis of rotation in a first direction, a basket of said plurality of water porous baskets rotates a first distance from said inlet to said exhaust outlet, and when rotated about said axis of rotation in a second direction opposite to said first direction about said axis of rotation, said basket rotates a second distance from said inlet to said exhaust outlet, wherein, when said first and second distances are not equal, during a drying cycle said frame and said plurality of water porous baskets are rotated so as to pass from said inlet to said exhaust outlet along which ever distance is the longer distance of either said first or second distances so as to allow a maximum dwell time in said housing of an airstream forced into said housing through said inlet into drying contact with said articles in said plurality of water porous baskets before said airstream exits said housing through said exhaust outlet.

8. The device of claim 7 wherein said at least one spray nozzle include a pair of banks of spray nozzles radially spaced apart in said housing about said axis of rotation.

9. The device of claim 6 wherein said wash water supply comprises at least one spray nozzle for injecting wash water into said housing in a spray directed to include a portion of said spray perpendicular to said axis of rotation.

10. The device of claim 6 wherein each said basket is drawer-mounted into said frame for sliding removal of each said basket from said frame, a door in said housing providing access to said frame, said lid on each said basket operable once each said basket is slid from inside said frame through said door so as to facilitate loading and unloading said articles from each said basket.

11. The device of claim 10 wherein said frame includes slides so that each said basket of said plurality of baskets may be slid on said slides generally parallel to said axis of rotation through said door.

12. The device of claim 11 wherein said slides are telescopic slides mounted in sliding cooperation to said frame and to each said basket.

13. The device of claim 10 wherein said frame may be rotated so as to sequentially position each said basket adjacent said door for sequential access to said plurality of water porous baskets.

14. The device of claim 6 wherein said housing is a cylindrical drum radially symmetric about said axis of rotation and wherein said frame is a cage symmetrically shaped relative to said axis of rotation, and wherein said plurality of water porous baskets are mounted in radially spaced array on said cage, radially spaced about said axis of rotation.

15. The device of claim 14 wherein said plurality of water porous baskets are slidably mounted on said cage for sliding of each said basket from said housing when said cage is stationary before engaging a washing or drying cycle of said device.

16. The device of claim 15 wherein said baskets are open-lattice rigid baskets.

17. The device of claim 14 wherein each said basket is generally rectangular, one side of said basket conformally curved to correspond in shape to a cylindrical inner surface of said housing.

18. The device of claim 17 wherein said cage is a cylindrical frame-work of rigid hoops held rigidly apart and rigidly perpendicular to a center axis member by radially spaced apart spokes, said center axis member co-axial with said axis of rotation, said hoops sized for snug fitment within said inner surface of said housing.

19. The device of claim 18 wherein said inner surface of said housing is a rigid perforated liner spaced radially inwardly from an exterior cylindrical wall of said housing.

20. The device of claim 6 wherein each said basket further comprises an air and fluid porous spacer for placing between said articles when held within each said basket for facilitating fluid and air flow between said articles.

21. The device of claim 20 wherein each said basket further comprises a removable compartmentalized porous bag releasably mountable into each said basket, wherein said bag is sized to fold over said spacer and when so folded to snugly fit into each said basket.

22. The device of claim 21 wherein said bag is folded in half.

23. The device of claim 6 wherein said each basket further comprises a removable compartmentalized porous bag releasably mountable into each said basket.

24. The device of claim 23 wherein compartments within said bag are porous and sized to firmly hold specific articles of said articles within said bag in an optimized spatial relationship relative to said frame and said housing when a plurality said bags are releasably mounted in each said basket for optimized washing penetration of said wash water into and through said articles and for optimized penetration of drying air into or through said articles.

25. The device of claim 24 wherein said bag holds said articles in spaced apart array in said compartments.

26. The device of claim 24 wherein said articles are held in said bag in a substantially laid-flat orientation relative to an inner side of each said basket, said inner side radially innermost in relation to said axis of rotation.

27. A device for washing articles of apparel comprising;

a frame, a tub rigidly mounted to said frame, a basket rotatably mounted inside said tub, said basket, an open-lattice sided container having a releasably closable lid, said basket for holding therein said articles of apparel substantially stationary relative to said basket as said basket is rotated relative to said tub, a water supply cooperating with said tub for washing and rinsing said articles held in said basket, a mesh bag for holding said articles of apparel, said mesh bag removably securable within said basket, wherein said mesh bag is compartmentalized for simultaneously holding in spaced apart array various articles of said articles of apparel in said mesh bags when held in said basket.

28. The device of claim 27 wherein said mesh bag includes a main compartment of a generally rectangular parallelepiped shape mountable into said basket so as to lay said mesh bag flat in said basket.

29. The device of claim 28 wherein said mesh bag is sized so as to fit in said basket when said mesh beg is folded in half and laid flat, and wherein said basket further comprises a rigid open-lattice spacer positionable between folded-over halves of said mesh bag.

* * * * *